United States Patent [19]

Kimura et al.

[11] 4,345,834

[45] Aug. 24, 1982

[54] TRANSFER TYPE ELECTROSTATIC COPYING APPARATUS

[75] Inventors: Hiroshi Kimura, Neyagawa; Masahiko Hisajima, Osaka; Yutaka Shigemura, Takarazuka, all of Japan

[73] Assignee: Mita Industrial Company Limited, Osaka, Japan

[21] Appl. No.: 85,518

[22] Filed: Oct. 17, 1979

[30] Foreign Application Priority Data

| | | | |
|---|---|---|---|
| Nov. 2, 1978 | [JP] | Japan | 53-135331 |
| Dec. 31, 1978 | [JP] | Japan | 53-182460[U] |
| Dec. 31, 1978 | [JP] | Japan | 53-182461[U] |
| Dec. 31, 1978 | [JP] | Japan | 53-182462[U] |
| Jul. 3, 1979 | [JP] | Japan | 54-84540 |
| Jul. 3, 1979 | [JP] | Japan | 54-92103[U] |

[51] Int. Cl.[3] ..... G03G 15/00

[52] U.S. Cl. ..... 355/3 R; 355/3 DR; 355/3 FU

[58] Field of Search ..... 355/3 R, 3 DD, 8, 14 R, 355/14 DD, 3 DR, 3 FU

[56] References Cited

U.S. PATENT DOCUMENTS

| | | | |
|---|---|---|---|
| 3,669,535 | 6/1972 | Hyosaka et al. | 355/8 |
| 3,809,475 | 5/1974 | Post et al. | 355/3 R |
| 3,918,805 | 11/1975 | Limberger et al. | 355/8 |
| 3,918,808 | 11/1975 | Narita | 355/15 |
| 4,009,957 | 3/1977 | Suzuki et al. | 355/14 |
| 4,032,225 | 6/1977 | Williams | 355/14 D X |
| 4,076,402 | 2/1978 | Kanno et al. | 355/3 DR |
| 4,101,214 | 7/1978 | Irie et al. | 355/14 D X |
| 4,114,998 | 9/1978 | Shimizu et al. | 355/3 DR |
| 4,124,288 | 11/1978 | Zeuthen | 355/8 |
| 4,165,169 | 8/1979 | Miyashita et al. | 355/3 DR |
| 4,165,965 | 8/1979 | Bernardelli et al. | 355/3 FU X |

*Primary Examiner*—Fred L. Braun

*Attorney, Agent, or Firm*—Wenderoth, Lind & Ponack

[57] ABSTRACT

A transfer type electrostatic copying apparatus in which the area of a photosensitive member cleaned by a cleaning device reaches an exposure zone simultaneously or prior to the arrival of a movable portion of an optical system or an original carrier at an exposure starting position from a home position thereof. This results in clear and definite copied images being obtained. At the earlier stage at which the movable portion of the optical system or the original carrier starts moving, the photosensitive member is subjected to the cleaning process, and then the exposure process is effected when the movable portion or the original carrier is running stably. Thus, the electrostatic latent image obtained by the exposure are clear and definite and free from undesirable blurs. The photosensitive member is a rotary drum having bosses connected at opposite axial ends thereof which are removably mounted in holder members on the sidewalls of the copying apparatus. A conical-shaped shaft which rotatably supports the drum has a threaded portion thereon which cooperates with a threaded portion in one of the bosses to secure the shaft to the bosses.

11 Claims, 24 Drawing Figures

TRANSFER TYPE ELECTROSTATIC COPYING APPARATUS

BACKGROUND OF THE INVENTION

1. Field of the Invention

The present invention relates to an electrostatic copying apparatus of a type in which a toner image or an electrostatic latent image corresponding to an original document and formed on a surface of a photosensitive member is transferred onto a transfer paper such as a copy paper and the like, and more particularly, to a control system for controlling the movement of a movable portion of an optical system intended to form the image of the original document on the photosensitive member through exposure, or the movement of an original support table, and also for controlling the cleaning operation by a cleaning device which is arranged to carry out the cleaning operation through removal of toner or electrical charge remaining on the surface of the photosensitive member after transfer.

2. Description of the Prior Art

In some conventional transfer type electrostatic copying apparatuses, the movable portion of an optical system for forming through exposure an electrostatic latent image corresponding to an original document on a photosensitive drum, which is contructed by providing a photosensitive layer on the outer periphery of a drum, is located at a home or initial position when copying is not carried out. Adjacent to the outer periphery of the photosensitive drum, there is provided cleaning means which removes the residual toner remaining on the photosensitive layer, and the photosensitive layer thus is cleaned as the photosensitive drum rotates. For carrying out a copying operation, it is preferable to first clean the surface of the photosensitive drum and then effect the exposure. For this purpose, when a print button is depressed for the copying operation, the photosensitive drum first starts rotating and simultaneously, the copy paper begins to be fed, but the movable portion of the optical system remains stationary. Upon rotation of the photosensitive drum more than one time, the photosensitive layer of the photosenstive drum is to be cleaned over its entire peripheral surface. In the state where the above cleaning has been completed, the movable portion of the optical system starts moving thereby to effect the exposure and development, and thus, the image of the original document is copied onto the copy paper being continuously transported. In the conventional arrangement as described above, the presence is inevitable of the time period during which the movable portion of the optical system at rest is up to the effecting of the cleaning of the photosensitive layer for the photosenstive drum after the depression of the print button for the copying operation. Accordingly, from the viewpoint of reducing the time required for copying, omission of the cleaning time before the copying operation is strongly desired.

Furthermore, in the prior art transfer type electrostatic copying apparatus as described above, when a plurality of copies are to be made successively, it is so arranged that, regarding the copy paper sheets after a second sheet, copy paper sheet to be subjected to subsequent copying operation is fed when the movable portion of the optical system is on its way back to the home position after completion of the exposure for the previous copying process, whereby reduction of the copying time for the copy paper sheets after the second sheet is intended. The prior art arrangement has a disadvantage in that, since the transportation starting timing for the first copy paper sheet immediately after depression of the print button and the transportation starting timing for the copy paper sheets after the second copy paper sheet differ from each other, the construction of the copy paper transportation control is undesirably complicated.

Moreover, in the conventional transfer type electrostatic copying apparatus, the exposure onto the photosensitive layer of the photosensitive drum is arranged to be effected simultaneously with the starting of the movable portion of the optical system, and therefore, in a transient time period during which the movable portion is brought from the stationary state to the running state at a predetermined speed suitable for exposure, there is a possibility that the image corresponding to the original document and formed on the photosensitive layer of the photosensitive drum is blurred, with the result that the image of the original document to be formed on the copy paper is made indefinite.

For preventing such blur in the image at an initial stage of movement of the movable portion of the optical system, it is necessary to preliminarily move the movable portion so that it is brought into the running state at a speed suitable for exposure. By operating in the above described manner, the moving distance of the movable portion must be made longer, thus resulting in a large size of the structure.

Accordingly, it is a primary object of the invention to provide a transfer type electrostatic copying apparatus in which reduction of the copying time is possible.

It is another object of the invention to provide a transfer type electrostatic copying apparatus of the above described type in which the construction of the transportation control of the transfer paper such as copy paper is simplified.

It is a further object of the invention to provide a transfer type electrostatic copying apparatus of the above described type which is compact in size and capable of achieving definite and clear copies.

In a typical prior art copy paper feeding device, the copy paper sheet at the top of the stack of copy paper sheets is caused to contact the copy paper feeding roller under pressure by elastically urging upwardly the mounting plate of a copy paper cassette in which the copy paper sheets are placed through spring means. In this prior art arrangement, if the size of the copy paper sheets is comparatively large with a consequent heavy weight, the pressure contact force between the copy paper feeding roller and the copy paper sheet at the top of the stack is small, while in the case where the size of the copy paper sheet is relatively small with a consequent light weight, the pressure contact force therebetween tends to be large. In other words, the pressure contact force between the copy paper feeding roller and the copy paper sheet at the top of the stack differs according to the sizes of the copy paper sheets, and consequently according to the weights of the copy paper sheets. Therefore, there are such disadvantages that a plurality of copy paper sheets are fed simultaneously or the copy paper sheets are positionally deviated with respect to the transporting direction so as to be fed in an undesirable slanted orientation.

It is an object of this invention to provide a copy paper feeding device for a copying apparatus for feeding out copy paper sheets from a copy paper feeding cassette positively one sheet at a time.

In an electrostatic copying apparatus which is arranged to develop an electrostatic latent image formed on a photosensitive plate by employing a mixture of toner and carrier as a developing material, there is a tendency that, as many sheets of copies are made, only the toner is consumed, with its presence in the developing material being gradually decreased, and thus, favorable copied images can not be obtained due to reduction of image density on the copy paper. Therefore, it becomes necessary to replenish the developing material with toner equivalent in amount to the toner consumed.

Although the preferable content of toner in the developing material varies depending on the electrical and physical properties of toner and carrier, the content should generally be in the region of approximately 3 to 5 weight %, and if the content is smaller than this level, reduction in the image density takes place, while on the other hand, if the content is larger than the above level, the phenomenon generally referred to as fogging is brought about due to adhesion of the toner to non-image formed portion on the photosensitive plate, with a marked reduction in the image quality. Accordingly, it is required to precisely control the amount of toner to be replenished according to the copying operation.

Furthermore, the amount of toner to be consumed tends to appreciably vary according to the kinds of original documents to be copied, for example, original documents only with letters, those having many black portions, etc. or by the sizes of the documents. Accordingly it is necessary to adjust the replenishing amount of toner at each time.

Prior art toner replenishment control devices employed for the above purpose have such construction that, a toner replenishing roller provided at an opening formed at the lower portion of a toner replenishing container and having undulation or convex and concave portions on its peripheral surface is driven for rotation depending on necessity for supplying the toner accommodated to the toner replenishing container into a developing device. In the above arrangement, the driving force for the toner replenishing roller is normally transmitted thereto from a driving unit of the copying apparatus or an exclusive roller through mechanical control means. More specifically, the type conventionally employed for the above purpose in many cases has been such that, at each copying process, the rotational force transmitted from the driving unit is controlled as desired through a ratchet mechanism and the like so as to be transmitted to the toner replenishing roller for rotating said roller. However, the known mechanical control means as described above has such shortcomings that, since many parts of high precision are required, the adjustments thereof are difficult, while its control range is small, and further, various troubles are liable to take place.

Accordingly, it is an object of the invention to provide a toner replenishing control device which is capable of maintaining the mixing ratio of carrier to toner in the dual or two component developing material at a predetermined constant value.

By using the photosensitive drum for a long period, there is liable to happen that the electrical characteristics of the photosensitive layer provided on the outer periphery of the photosensitive drum are deteriorated or numerous small scratches or flaws are formed on the photosensitive layer. Therefore, it is required to periodically replace the photosensitive drum. Conventionally, various arrangements have been proposed for mounting the photosensitive drum on the copying apparatus housing without any contact with the photosensitive layer, but these known approaches have many problems such as troublesome procedures during mounting, necessity for tools, for example, a screw driver and the like, or possible damage to the photosensitive layer due to accidental contact of the photosensitive drum with the apparatus housing.

It is an object of the invention to provide a transfer type electrostatic copying apparatus in which a photosensitive drum is capable of being positively mounted to an apparatus housing through easy handling thereof.

In the heating and fixing device, the copy paper on which a toner image is formed is arranged to be passed between a fixing roller accommodating therein a heater element and a pressure roller contacting the fixing roller under pressure for fixing through the heating. In one prior art arrangement, the tip of a blade is adapted to contact the fixing roller under pressure so as to scrape off an any toner adhering to the surface of the fixing roller for maintaining the surface of the fixing roller clean and also to prevent the copy paper from being wound around the fixing roller. There have been such cases that copy paper jamming takes place due to adhesion of the copy paper to the blade by residual toner stuck to the blade edge after having been removed from the surface of the fixing roller, or the copy paper is extensively soiled by the remaining toner on the blade edge or fused toner images on the copy paper sheet.

It is an object of the invention to provide a heating and fixing device for a copying apparatus for preventing a copy paper from being jammed and being soiled due to remaining toner on a blade which is arranged to prevent the copy paper from being wound around a fixing roller.

SUMMARY OF THE INVENTION

To accomplish the foregoing objectives, there is provided a movable portion of an optical system or an original carrier to move from a home or initial position and to return to the home or initial position, and during of this movement a photosensitive member is exposed. Cleaning means for cleaning the surface of the photosensitive member is located about the outer surface of the photosensitive member. The cleaned area of the photosensitive member reaches an exposure zone simultaneously or prior to the arrival of the movable portion or the original carrier at an exposure starting position from the home or initial position. Thereby clear and definite copied images are available. Further, the time required for the copying operation is appreciably reduced as compared with prior art arrangements, particularly due to the arrangement that the movable portion of the optical system or the original carrier starts movement at the same time as the initiation of the copying operation, and that the copying process is completed before it is returned to the home or initial position. Regarding the timing for starting the copy paper transportation, similar functioning conditions may apply even to the case where a plurality of copying processes are to be continuously effected, and therefore, the arrangement for the control thereof can be much simplified. Moreover, at the earlier stage at which the movable portion of the optical system or the original carrier starts moving, the photosensitive member is subjected to the cleaning process without being immediately subjected to the exposure process, as in the case in the prior art. Thus, since the exposure process in the invention is to be effected when the movable portion of the optical system or the original carrier is running stably, the electrostatic latent image obtained by the exposure is clear and definite and free from undesirable blurs.

There is provided a copy paper feeding device which has a plurality of cassettes capable of being selectively mounted in and withdrawn from an apparatus housing. Each cassette has a mounting plate for mounting stacked copy paper sheets. A trailing portion of the mounting plate is swingable around an axis intersecting at a right angle with a copy paper feeding direction. A pair of engaging claws are provided for contacting forward and both side ends of a top sheet of the copy paper sheets. A copy paper feeding roller is rotatably journalled above the cassette at a stationary position of the apparatus housing. A push up member is spring-biased for pushing upwardly the mounting plate so as to allow the top sheet to contact the copy paper feeding roller. The mounting plate has a projection at a portion contacting the push up member. The projection is to be small or large depending on the use of small or large size copy paper. The pressure contact force between the copy paper feeding roller and the copy paper sheet at the top of the stack is maintained constant according to the sizes of the copy paper sheets, and consequently according to the weights of the copy paper sheets. Therefore, copy paper sheets are fed out from the cassette positively one sheet at a time.

In the case where the photosensitive member is a photosensitive drum, a pair of bearings for holding a rotary shaft have a common axis and are mounted on side walls on both sides of the photosensitive drum in the direction of the axis thereof. The inner diameter of one bearing is formed larger than that of the other bearing. A tip portion of the rotary shaft is formed into an approximate conical shape toward the free end side. A coupling for transmitting driving force to the rotary shaft and having the same axis as the bearings is provided on the opposite side of the photosensitive drum regarding the other bearing by insertion of the rotary shaft to the coupling. A boss of the photosensitive drum extends outwardly in the direction of the axis. On the confronting surfaces of the side walls, holder members, each of which has a holding face open upwardly or slantingly upwardly, are rigidly fixed. The axis of the photosensitive drum is located slightly below the axis of the bearings with the boss contacting the bottom of the holding face, and the photosensitive drum and the rotary shaft are capable of being secured. Therefore, it is possible to mount the photosensitive drum to the apparatus housing positively through easy handling of the photosensitive drum.

There is provided a toner supplying control device for developing an electrostatic latent image by a dual component developing material stored in a sump and for returning the overful dual component developing material into the sump after completion of developing. The control device comprises a toner supplying device for feeding a toner from the sump, an electric driving device for driving the toner supplying means, and means for electrically energizing the electric driving device so as to feed into the sump an amount of the toner equal to that consumed during the copying operation. Accordingly it is possible to maintain the mixing ratio of carrier to toner in the dual component developing material at a predetermined constant value.

The transfer type electrostatic copying apparatus comprises a heating and fixing device for fusing a toner image on the copy paper sheet which is passed between a fixing roller provided with a heater and a pressure roller. A forward edge of a blade elastically contacts under pressure the fixing roller at the discharge side of the rollers. A plurality of guide members are provided with the blade and extend downward from the blade along the feeding direction of the copy paper in spaced relation from each other in the widthwise direction of the copy paper transport path. Therefore, it is prevented that a copy paper is jammed and soiled due to remaining toner on the blade which is arranged to prevent the copy paper from being wound around the fixing roller.

In a preferred embodiment, electrical energizing means of the toner supplying control device comprises means for detecting either one of the width or length of a copy paper sheet, or for detecting both of the width and the length of the copy paper sheets, and energizes an electric driving device so that an amount of toner corresponding to either the width or the length, or both of the width and the length of the copy paper sheet is fed.

BRIEF DESCRIPTION OF THE DRAWINGS

A detailed description of the invention will be made with reference to the accompanying drawings, wherein like numerals designate corresponding elements in the various figures and wherein.

DETAILED DESCRIPTION OF THE PREFERRED EMBODIMENT

General Construction

Figure 1:
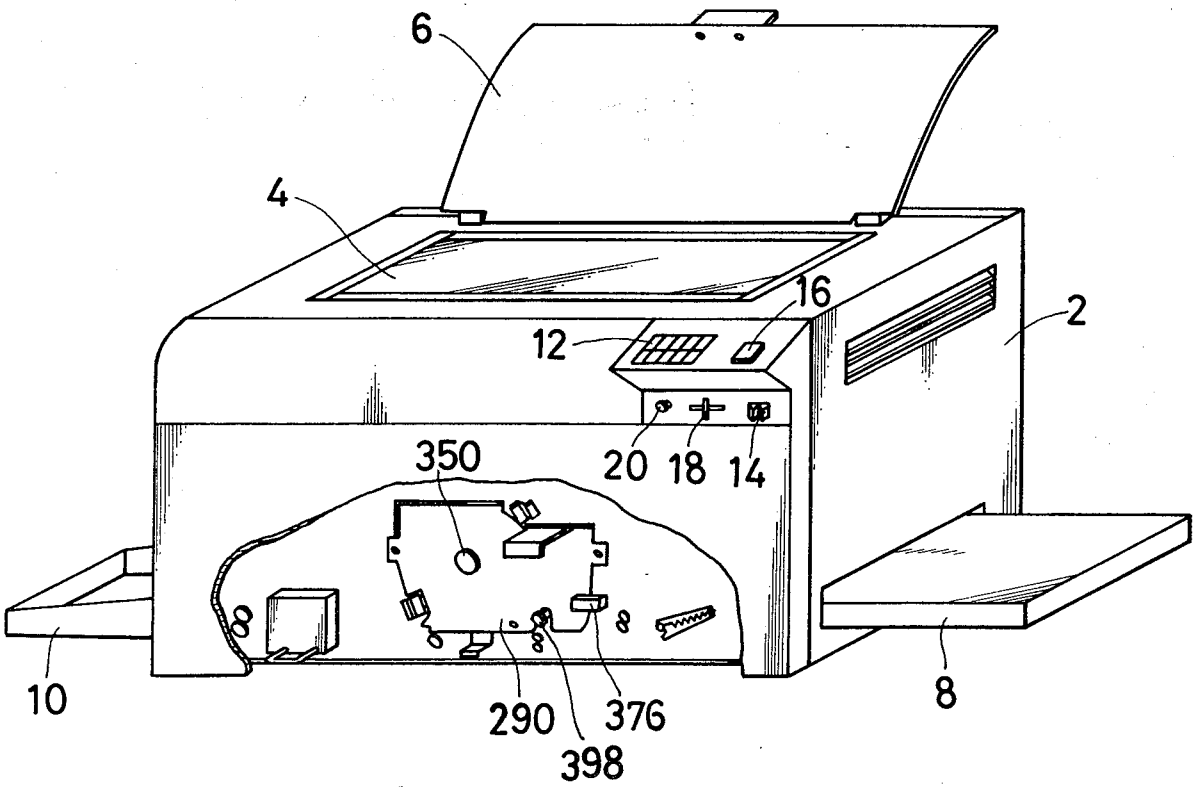
FIG. 1 is a perspective view of a transfer type electrostatic copying apparatus according to one preferred embodiment of the invention.

Referring now to FIG. 1 which is a perspective view, partly broken away, of a transfer type electrostatic copying apparatus according to one preferred embodiment of the invention, the transfer type electrostatic copying apparatus is fundamentally so arranged that, through reciprocating movement of a movable portion which is a part of the optical system including an exposure lamp, etc. for forming an image corresponding to an original document on a photosensitive layer of a photosensitive drum, an electrostatic latent image corresponding to the original document is formed on the photosensitive layer so as to be subsequently developed by a dual component developing material including carrier and toner, and the toner image thus obtained is further transferred onto a copy paper and then fixed to the copy paper through heating. At the upper portion of an apparatus housing 2 of the copying apparatus, there is provided a transparent plate 4 on which an original document is placed horizontally, while an original document presser plate 6 for causing the original document to contact the transparent plate 4 under pressure is further provided. As shown in FIG. 1, a copy paper feeding cassette 8 in which the copy paper sheets are accommodated is exchangeably and releasably mounted at the right hand end portion of the apparatus housing 2. The copy paper feeding cassette 8 as described above can be withdrawn rightwardly from the apparatus housing 2 in FIG. 1. The copy paper sheets after completion of the copying operation are discharged onto a copy paper tray 10 provided at the left hand end of the apparatus housing 2 in FIG. 1. The number of copy paper sheets for each original document in a continuous copying operation is to be set by a copy number set button 12 disposed at a front upper portion of the apparatus housing 2. For a copying operation, the number of copies to be made is set by the copy number set button 12 after closing a main switch 14, and then, a print button 16 is depressed. The amount of exposure of a photosensitive layer 24 of a photosensitive drum 26 mentioned later to the imagewise light of the original document through an optical system is capable of being adjusted by an exposure amount adjusting knob 18. Meanwhile, by adjusting a toner replenishing amount control knob 20 depending on the degree of darkness of the orignal document, the mixing ratio of toner to carrier may be manually adjusted to a predetermined value.

Figure 2:
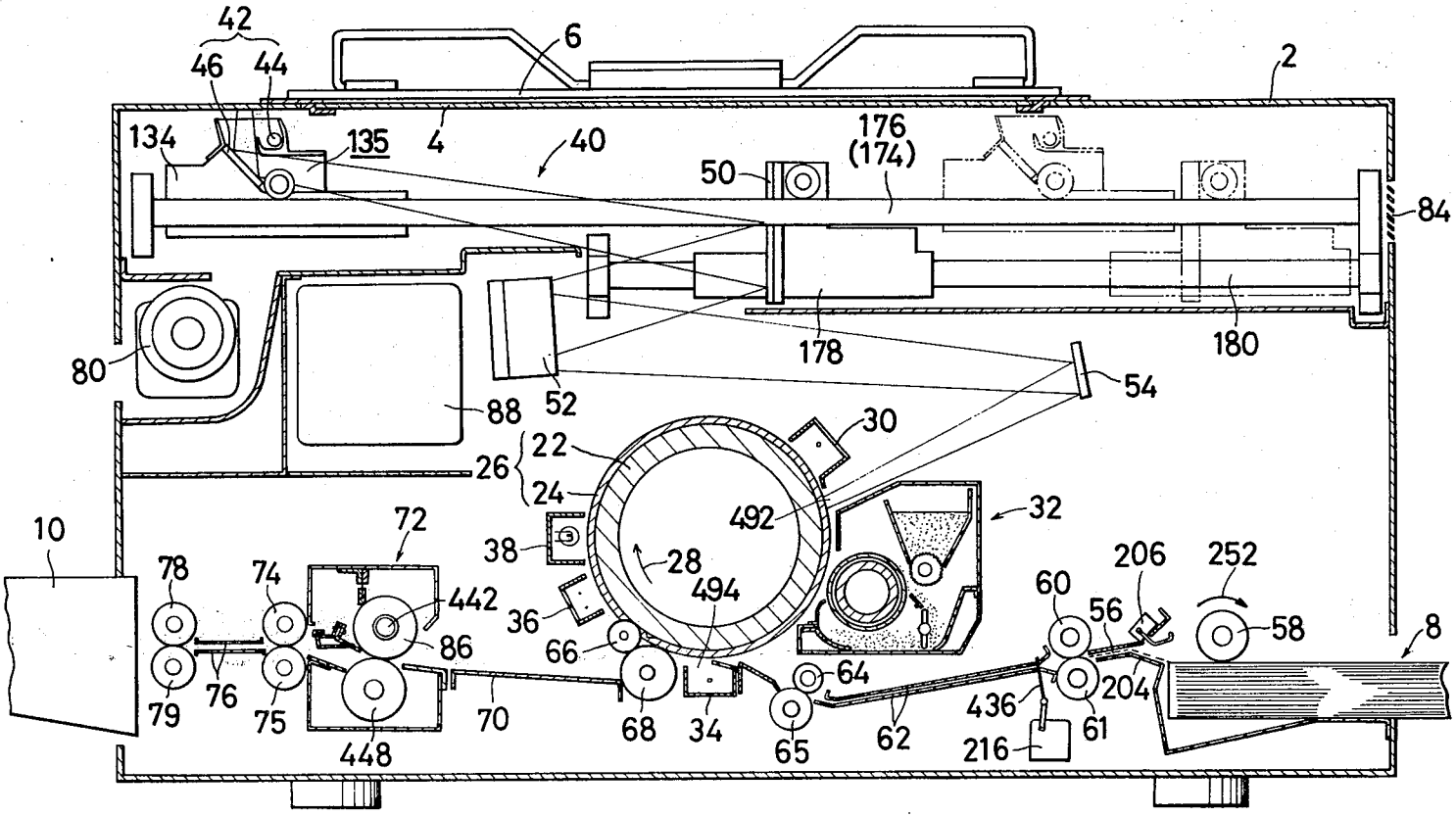
FIG. 2 is a schematic side sectional view as observed from the front side of the copying apparatus of FIG. 1.

In FIG. 2 showing a schematic side sectional view as observed from the front side of the copying apparatus of FIG. 1, at an approximately central portion of the apparatus housing 2, there is rotatably disposed the photosensitive drum 26 including the photosensitive layer 24 provided on the entire peripheral surface of a cylindrical drum 22. Around the photosensitive drum 26 along its rotational direction 28, there are sequentially disposed a charging corona charger 30 for charging the photosensitive layer 24, a conventional developing device 32 for developing the electrostatic latent image formed on the photosensitive layer 24 into a visible toner image and also for removing the toner remaining on the photosensitive layer 24 after a transfer operation, for the purpose of cleaning a transfer corona charger 34 for transferring the toner image formed on the photosensitive layer 24 onto the copy paper, a charge erasing corona discharger 36 for removing residual charge remaining on the photosensitive layer 24 after the transfer process and a charge erasing lamp 38.

In a position above the photosensitive drum 26, an optical system 40 is provided for projecting the lightwise image of the original document onto the photosensitive layer 24 between the corona charger 30 and developing device 32 as shown in FIG. 2. The optical system 40 includes a light projection means 42 for directing the light toward the original document and including an exposure lamp 44 and a reflecting mirror 46. The light directed from the above light projection means 42 to the original document and reflected thereby is projected onto the photosensitive layer 24 through a movable reflecting mirror 50, a lens assembly 52 having an in-mirror and another reflecting mirror 54 so as to form the image of the original document on the photosensitive layer 24 in the form of the electrostatic latent image.

The copy paper sheets stacked and accommodated in a cassette 8 are fed one sheet at a time from the cassette 8 by a copy paper feeding roller 58 along a copy paper transport path 56 shown by a dotted line, and through a pair of transport rollers 60 and 61 and guide plates 62, are further fed inwards so that each sheet closely contacts the photosensitive layer 24 of the photosensitive drum 26 at a position confronting the transfer corona charger 34 of another pair of transport rollers 64 and 65. After completion of the transfer operation, the copy paper sheet is separated from the photosensitive layer 24, with one edge in the widthwise direction of the copy paper sheet being held between a separating roller 66 and a transport roller 68, and is subsequently fed into a heating and fixing device 72 through a guide plate 70 for fixing the toner image onto the copy paper sheet through heating. The copy paper after the fixing operation is discharged onto copy paper tray 10 through a pair of transport rollers 74 and 75, guide plates 76, and a pair of discharge rollers 78 and 79.

Inside the apparatus housing 2, there is provided a cooling fan or blower 80 which draws in air from the outside for blasting it toward the lower portion of the transparent plate 4 so as to cool the transparent plate thereby. Thereafter, the air is discharged from a discharge opening 84.

Driving System

Figure 3:
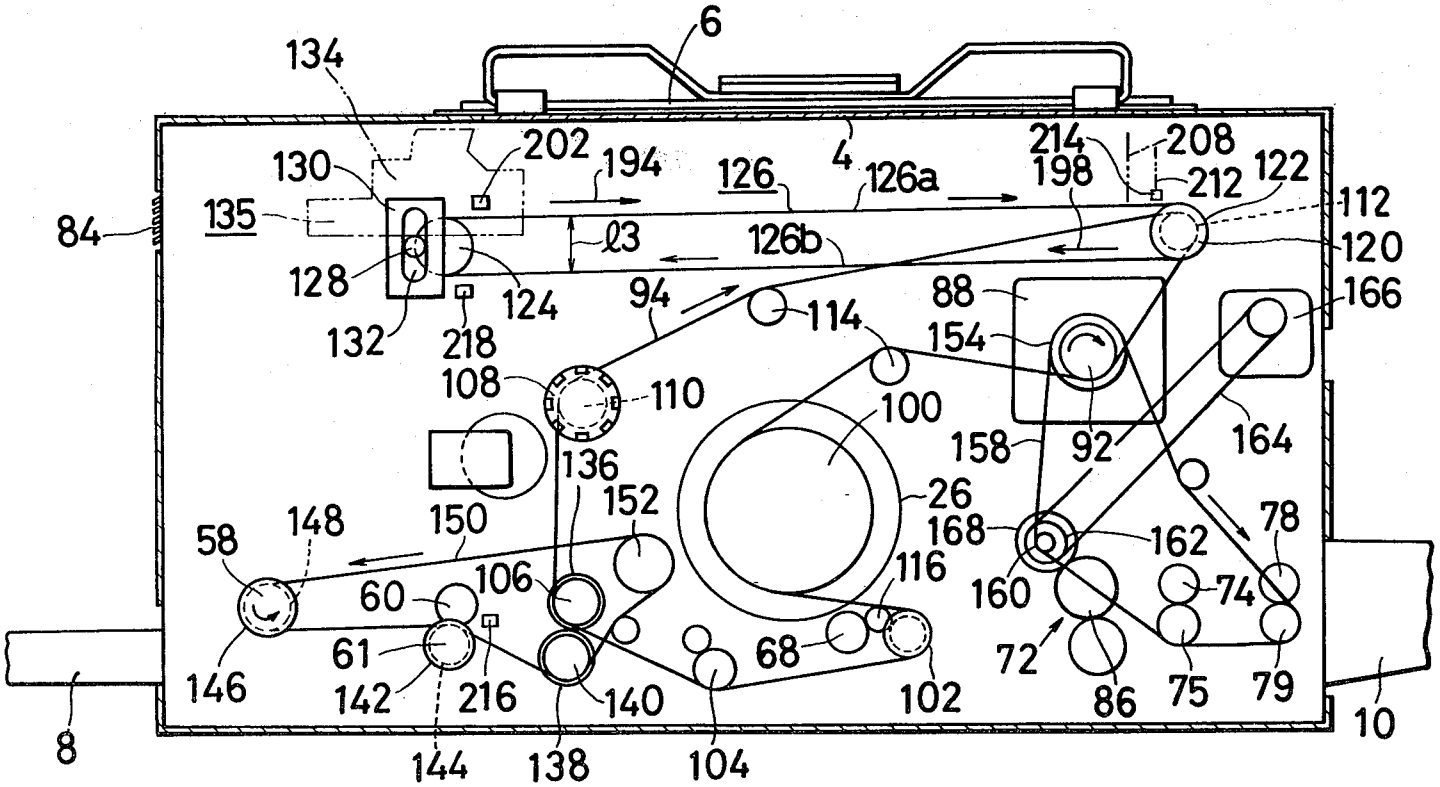
FIG. 3 is a schematic rear side view of the copying apparatus according to the invention for illustrating a driving system.

Referring particularly to FIG. 3 showing a schematic rear side view of the copying apparatus according to the invention for illustrating a driving system thereof, a first endless chain 94 is passed around a sprocket wheel 92 to be rotated by a motor 88. The chain 94 is further directed around sprocket wheel 100 for driving the photosensitive drum 26, a sprocket wheel 102, another sprocket wheel 114, a further sprocket wheel 104 coupled with a feeding transport roller 65, a driving sprocket wheel 106, a sprocket wheel 110 connected to a rotary disc 108 for generating timing pulses, and a sprocket wheel 112 for reciprocating the light projection means 42. The sprocket wheel 102 drives the transport roller 68 through a gear train 116. On the sprocket wheel 112, a sprocket wheel 122 to be driven is coaxially mounted through a magnet clutch 120 so as to be rotatably supported on the apparatus housing 2. In a spaced relation from the sprocket wheel 122 in a horizontal direction, another sprocket wheel 124 having the same external diameter is rotatably supported by the apparatus housing 2. Between the sprocket wheels 122 and 124, a chain 126 is passed around horizontally and in an endless form, with an engaging projection 128 being secured to the chain 126. The projection 128 is loosely fitted for engagement in an elongated opening 132 formed in a movable member 130. The elongated opening 132 has a vertical axis intersecting at right angles with the straight and horizontal upper or forward and lower or backward runs **126*a* and 126*b* of the chain 126. The length of the elongated opening 132 in the vertical direction is determined so as to provide that the projection 128 is permitted a displacement at least with respect to member 130 of the maximum distance l3 between the horizontal upper and lower runs 126*a* and 126*b* of the chain 126. The movable member 130 mentioned above is secured to a support member 134 (see FIGS. 2 and 4) for supporting the exposure lamp 44 and reflecting mirror 46. The light projecting means 42, movable reflecting mirror 50, movable member 130 and support member 134 constitute a movable portion 135 of the optical system 40. Accordingly, when the chain 126 is caused to move, with the sprocket wheels 112 and 122 being coupled by the magnet clutch 120, the projection 128 slides within the elongated opening 132 vertically for allowing the moving member 130 and support member 134** to reciprocate horizontally.

Meanwhile, the rotational driving force from the driving sprocket wheel 106 is transmitted to a sprocket wheel 140 through gears 136 and 138. To the transport roller 61, a sprocket wheel 144 is connected through a magnet clutch 142, while the copy paper feed roller 58 is provided with a sprocket wheel 148 through a magnet clutch 146. A second chain 150 in endless form is directed around the sprocket wheels 140, 144, 148 and 152 as shown.

Around another sprocket wheel 154 of the motor 88, a third endless chain 158 is directed so as to drive for rotation a fixing roller 86 of the heating and fixing device 72 through a gear train 168, and also the transport rollers 75 and 79. A sprocket wheel 162 provided in association with the fixing roller 86 is driven by an auxiliary motor 166 through a fourth endless chain 164. To the fixing roller 86, a sprocket wheel 160 is connected through a first one-way clutch, while sprocket wheel 162 is also connected through a second one-way clutch. The rotational speed of the sprocket wheel 160 by the motor 88 is higher than the rotational speed of the sprocket wheel 162 by the auxiliary motor 166. Therefore, when the motor 88, and consequently the sprocket wheel 160 stops rotating, the rotational driving force of the sprocket wheel 162 is transmitted to the fixing roller 86. The auxiliary motor 166 keeps rotating at all times upon closing of the main switch 14. When the motor 88 is rotating, the rotational driving force of the sprocket wheel 160 is transmitted to the fixing roller 86. Accordingly, the fixing roller 86 is driven for rotation by the motor 88 during the copying operation, and for rotation at a lower speed by the auxiliary roller 166 when the copying operation is not effected. Consequently, it is possible to keep the fixing roller 86 standing-by at all times at a temperature suitable for fixing through rotation thereof at a slow speed, and thus copying efficiency is improved during intermittent copying operations.

Figure 4:
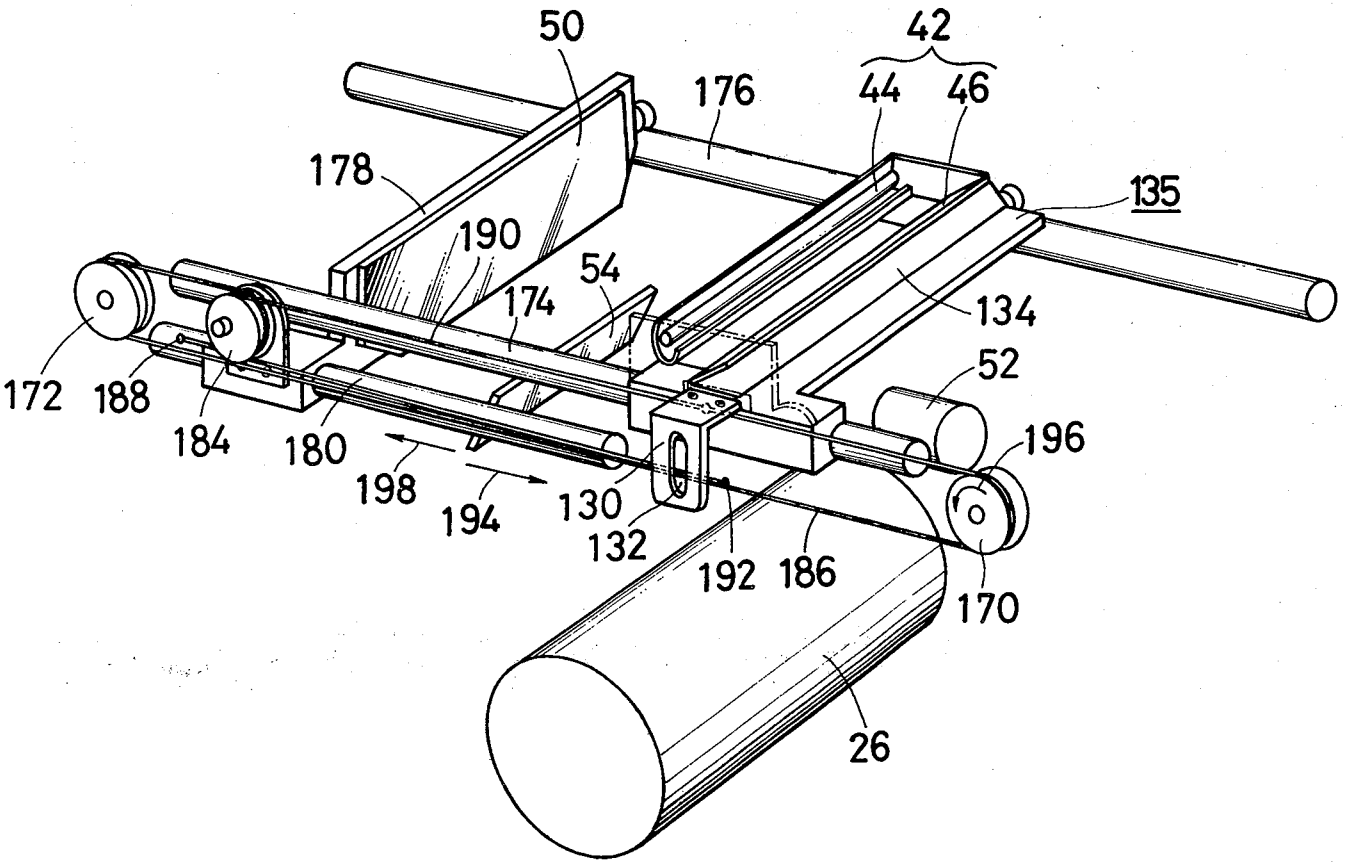
FIG. 4 is a simplified perspective view illustrating structure for moving a light projecting means; a reflecting mirror and a movable reflecting mirror.

Referring also to FIG. 4 showing a simplified perspective view illustrating constructions for moving the light projecting means 42, reflecting mirror 46 and movable reflecting mirror 50 as observed from the rear side of the copying apparatus according to the invention, pulleys 170 and 172 each having a horizontal axis are rotatably provided in spaced relation from each other in a horizontal direction at leftward and rightward end portions of the apparatus housing 2.

The exposure lamp 44 and reflecting mirror 46 are fixed to support member 134, which is guided for reciprocating movement in a horizontal direction along a pair of spaced guide members 174 and 176, while another support member 178 for supporting the movable reflecting mirror 50 is also guided for reciprocating movement in a horizontal direction along guide members 176 and 180. To the support member 178, a pulley 184 having a horizontal axis is rotatably mounted. A wire 186 is secured at one thereof, to the support member 134 and is directed around each of the pulleys 170, 172 and 184 by about one half of the circumferences thereof, while the other end 188 of the wire 186 is fixed to the apparatus housing 2. Another wire 190 fixed at one end thereof to the support member 134 and is directed around the pulley 184 by about one half of its circumference, and other end 192 of the wire 190 is secured to the apparatus housing 2. Accordingly, when the support member 134 moves for returning toward the left in the direction indicated by arrow 198 in FIG. 4, the pulley 170 is rotated in the direction of arrow 196, while the movable reflecting mirror 50 is moved in parallel in the same direction of movement as that of the exposure lamp 44 and the reflecting mirror 46. In the above construction, the moving distance of the movable reflecting mirror 50 is $\frac{1}{2}$ of the moving distance of the support member 134 and thus the exposure lamp 44 and the reflecting mirror 46, and its moving speed is $\frac{1}{2}$ of the moving speed of the support member 134, the exposure lamp 44 and the reflecting mirror 46. The same state as described above also applies in the case where the support member 134 advances in the direction of the arrow 194.

When the light projection means 42 and support member 134 are at the home or initial position shown by imaginary lines in FIGS. 2 and 3, the projection 128 is located at the outer periphery of the sprocket wheel 124 and in a position farthest or most remote from the other sprocket wheel 122, and in this location the projection is positioned on a horizontal line passing through the axis of the sprocket wheel 124 and in a position opposite (i.e. at the left side in FIG. 3) to the sprocket wheel 122 with respect to suc axis. Accordingly, when the chain 126 starts moving, during the period in which the projection 128 moves from the home or initial position in FIG. 3 by a distance equivalent to about $\frac{1}{4}$ of the circumference of the outer periphery of the sprocket wheel 124, the speed of the moving member 130 is gradually increased. Therefore, the application of an impulsively large load during starting is advantageously prevented, while movement of the movable portion 135 including the light projecting means 42, support member 134, etc. can be smoothly started.

Upon closing the main switch 14, the auxiliary motor 166 and a heater element 442 provided in the fixing roller 86 are energized. By subsequently depressing the print button 16, the motor 88 starts rotation and the charge erasing lamp 38 is also lit. The rotation of the motor 88 causes the chains 94, 126, 150 and 158 to move, whereby the moving member 130 and support member 134 are advanced in the direction indicated by the arrow 194 by the movement of the projection 128 following the running of the chain 126. By the advancing of the moving member 130, a detection switch 202 disposed in the vicinity of the home position is actuated so as to turn ON the magnet clutch 146 which previously has been in the OFF state. Consequently, the copy paper feeding roller 58 remaining stationary up to that time starts rotation, and a single sheet of copy paper is supplied from the copy paper feeding cassette 8. In the above case, the magnet clutch 142 remains in the OFF state, and thus, the transport rollers 60 and 61 remain stationary without rotating. Therefore, when the leading edge of the copy paper stops as it contacts the pressure contact portion between the transport rollers 60 and 61, and the copy paper feeding roller 58 continues to rotate further, the copy paper sheet is caused to curve upwardly in a direction opposite to the guide plate 204 (see FIG. 2) thereby to actuate a detection switch 206. By the actuation of the detection switch 206, the magnet clutch 146 is turned OFF, and the copy paper feeding roller 58 stops rotating, and consequently, the copy paper is maintained in a once stopped state under the above condition. When the moving member 130 advances together with the light projecting means 42 in the direction of the arrow 194 and reaches a portion 208 prior to the sprocket wheel 122, the exposure lamp 44 is illuminated.

To the sprocket wheel 110 to be rotated by the chain 94 is rigidly fixed, rotary disc 108 having a plurality of notches radially formed at its peripheral edge, in a manner similar to gear teeth. At opposite ends of the rotary disc 108 along the direction of its axis, a light emitting element and a corresponding light receiving element (not shown) are disposed. When the rotary disc 108 is rotated, light from the light emitting element to the light receiving element is selectively allowed to pass or is cut off repeatedly by the presence of the notches, and thus, timing pulses are produced. The number of the timing pulses corresponds to the positions in the reciprocating directions 194 and 198 of the support member 134 and consequently of the light projecting means 42, and therefore, the earlier mentioned rearward position 208 is to be determined by the number of the timing pulses.

Immediately after depression of the print button 16, the charge erasing corona charger 36 is energized. The photosensitive drum 26 is rotated more than one turn, for example, about 1.1 turns during the advancing of the support member 134 in the direction of the arrow 194 and returning thereof in the direction of the arrow 198, respectively. Accordingly, during advancing in each of the copying operations, the entire peripheral surface is subjected to the developing device 32 having also a cleaning function, charge erasing lamp 38 and charge erasing corona charger 36. Therefore, even in the initial copying operation after depression of the print button 16, the photosensitive layer 24 is subjected to exposure after having been cleaned, and thus, a favorable copied image on the first sheet is available in a manner similar to copying after the second sheet.

Upon further movement of the chain 126, when the projection 128 reaches a position 212 before the sprocket wheel 122, a detection switch 214 provided at position 212 is actuated, whereby the magnet clutch 142 is brought into the engaged state, and the rotational driving force from the sprocket wheel 144 is transmitted to the transport roller 61, and thus, the copy paper sheet once stopped is further transported towards the transfer zone 494. Meanwhile, after the actuation of the detection switch 214, the transfer corona charger 34 is actuated when a predetermined number of pulses has been reached. Accordingly, the sum of the time required from the actuation of the detection switch 214 to the starting of the exposure, and the time during which the photosensitive layer 24 of the photosensitive drum 26 moves from the exposure zone 492 to the developing device 32 for visualizing the latent image thereby and then reaches the transfer zone 494 for transfer by the transfer corona charger 34, is equal to the time required for the copy paper sheet to reach the transfer zone 494 for transfer by the transfer corona charger 34 through the transport rollers 60 and 61. When the projection 128 is located at the straight lower run **126*b* after going around about one half of the circumference of the sprocket wheel 122, the image of the original document is projected onto the photosensitive layer 24, and subsequently, the toner image thereof is obtained on the photosensitive layer 24 by the developing device 32. The circumferential speed of the photosensitive drum 26 is equal to the speed of the light projecting means 44 during exposure. The toner image formed on the photosensitive layer 24 is transferred onto the copy paper sheet by the action of the transfer corona charger 34. The charging corona charger 30 is actuated by a detection switch 216 provided at the discharge side of the transport rollers 60 and 61, and the detection switch 216 detects the copy paper sheet fed by the transport rollers 60 and 61 by an actuator 436 contacting the copy paper sheet. The circumferential speed of the photosensitive drum 26** is arranged to be equal to the transporting speed of the copy paper.

The detection switch 216 maintains its operating state during passing of the copy paper sheet, and based on the timing pulses produced by the rotation of the rotary disc 108 after the copy paper has passed through the position of the detection switch 216, the charging corona charger 30 is first made inoperative after the copy paper sheet has passed through the transfer zone 494, and then, the exposure lamp 44 is de-energized, and thereafter, the transfer corona charger 34 is rendered inoperative. When the support member 134 advances in the direction of the arrow 198 and reaches the original home poisition, a detection switch 218 is actuated, by which the magnet clutch 120 is turned OFF and the transmission of power from the sprocket wheel 112 to sprocket wheel 122 is cut off, with the movement of the chain 126 being stopped. The moving member 130 returning to the rest position by the inertia force in the direction indicated by the arrow 198 as shown in FIG. 3. After the actuation of the detection switch 218, on the basis of the timing pulses generated by the rotary disc 108, the motor 88 is kept energized until such time as the longest copy paper sheet available for copying has been discharged onto the copied paper tray 10, and at the same time with the de-energization of the motor 88, the charge erasing lamp 38 and charge erasing corona charger 36 are de-energized. The auxiliary motor 166 continues to rotate during the time period in which the main switch 14 is turned ON.

Alternatively, the above arrangement may be so modified that the copy paper is completely discharged out of the apparatus housing 2 before the support member 134 returns to the home position. In this case, the construction can be simplified by omitting the magnet clutch 120 and by directly coupling the sprocket wheels 112 and 122.

Copy Paper Feeding Device

Figure 5:
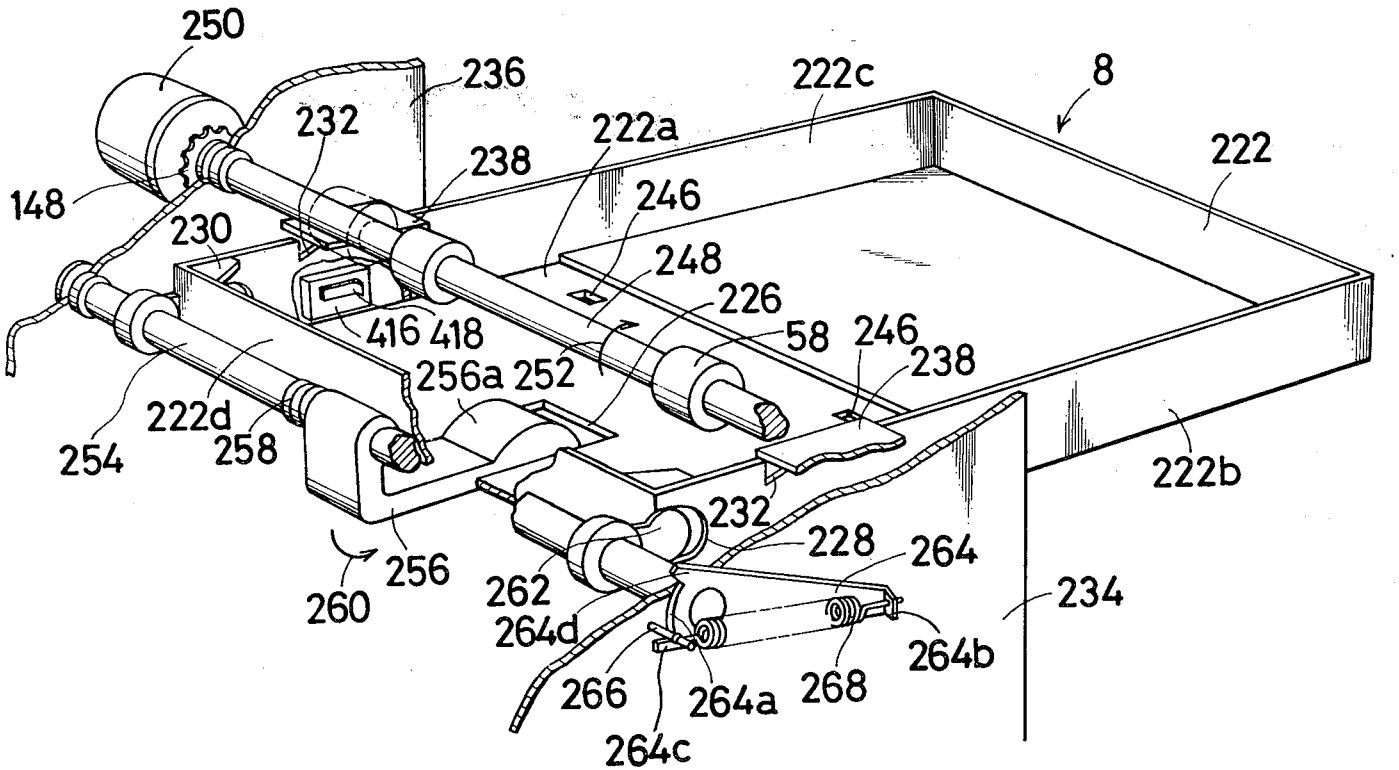
FIG. 5 is a perspective view of a copy paper feeding cassette.
Figure 6:
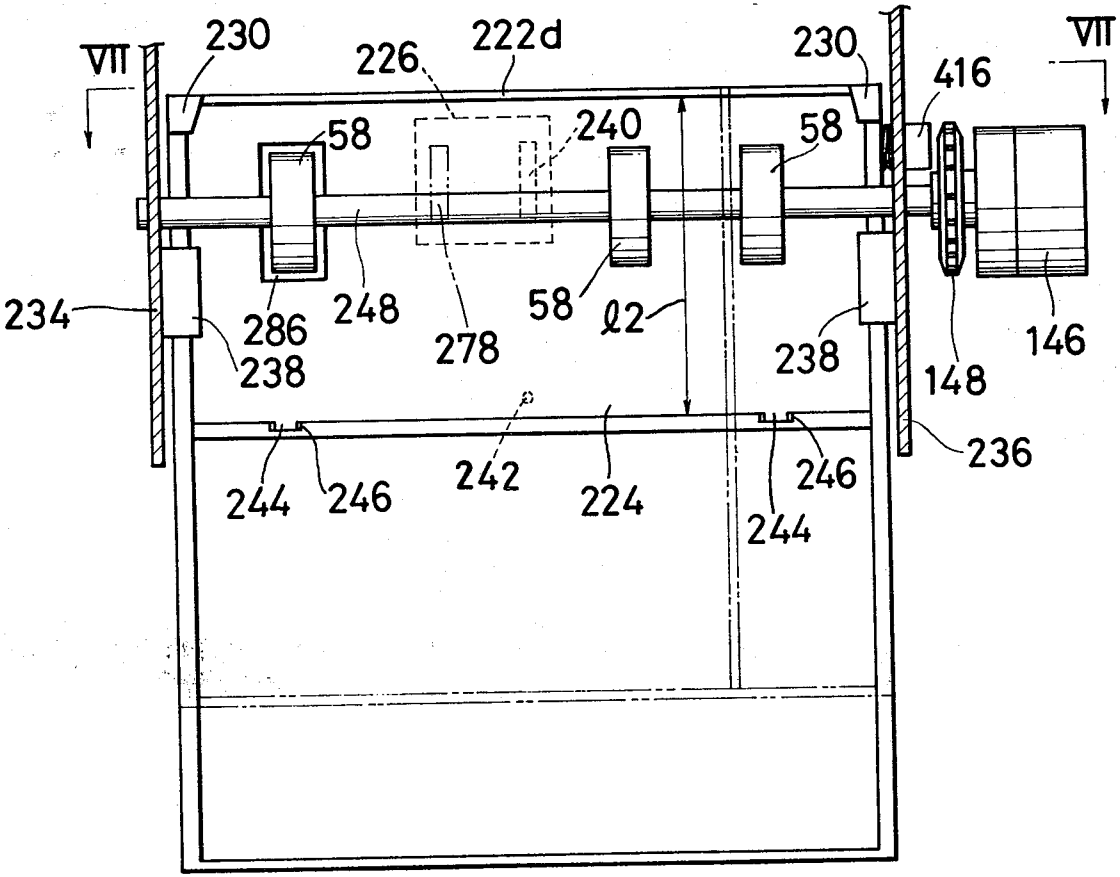
FIG. 6 is a top plan view of the arrangement of FIG. 5.
Figure 7:
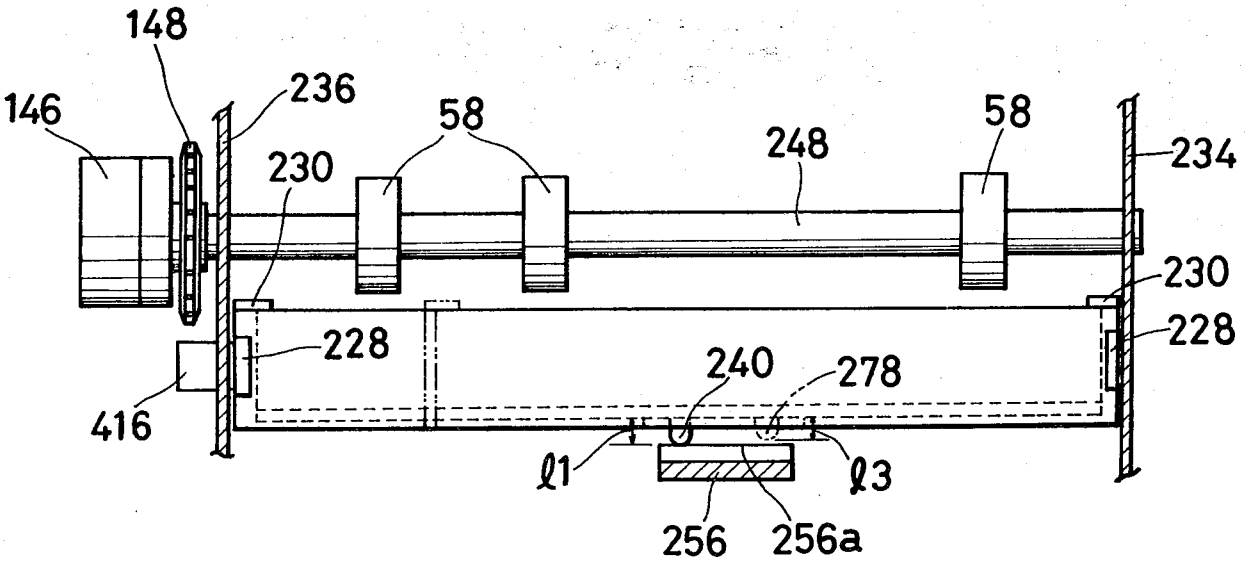
FIG. 7 is a cross section taken along the line VII—VII of FIG. 6.

FIG. 5 is a perspective view in the vicinity of the copy paper feeding cassette 8 when cassette 8 is mounted on the copying apparatus, FIG. 6 is a top plan view of the arrangement of FIG. 5, and FIG. 7 is a cross section taken along the line VII—VII of FIG. 6. The copy paper feeding cassette 8 is formed by a rectangular box-like container 222 open at its upper surface and accommodating therein copy paper sheets, for example, of JIS (Japanese Industrial Standard) B row size. At the forward half portion of a bottom 222*a* of the container 222, there is provided a mounting plate 224. It is to be noted that, in FIG. 5, the mounting plate 224 is omitted for simplification. At the forward end portion of the bottom 222*a* of the container 222, an opening 226 for receiving a copy push-up lever is formed, while at the forward end portions of opposite side walls 222*b* and 222*c* of the container 222, there are respectively formed engaging lever receiving recesses 228. Moreover, at the upper portions of corners defined by a front wall 222*d* and the opposite side walls 222*b* and 222*c*, vertically movable engaging claws 230 are provided so as to contact the top sheet of the copy paper by their weight. Furthermore, in the upper edges of the side walls 222*b* and 222*c*, notches 232 of wedge-like shape are respectively formed. On front and rear walls 234 and 236 of the apparatus housing, a pair of retaining plates 238 are provided, and the notches 232 of the copy paper feeding cassette 8 are engaged with the retaining plates 238.

On the under surface of the forward end portion of the mounting plate 224, there is provided a longitudinally extending projection 240 (vertically in FIG. 6) in central position between the opposite side walls 222*b* and 222*c*, i.e. at the central position in the widthwise direction of the copy paper sheet. In FIG. 7, the projection 240 faces the opening 226 and extends through the lower surface of the mounting plate 224 by a length l1. On the rear under surface of the mounting plate 224, there is provided a support projection 242 extending towards the bottom plate 222*a* of the container 222 in a central position between the opposite side walls 222*b* and 222*c*, i.e. at the central position in the widthwise direction of the copy paper sheet. Another pair of engaging pieces 244 are provided at the rear end portion of the mounting plate 224, and the engaging pieces 244 are bent to extend downwardly from the rear edge portion of the mounting plate 224, with their forward ends being bent rearwardly. The engaging pieces 244 are respectively fitted into engaging openings 246 formed in the bottom wall 222*a* of the container 222.

On the front and rear side walls 234 and 236, a shaft 248 on which a plurality (for example, three in FIG. 6) of copy paper feeding rollers 58 are secured is rotatably journalled so as to correspond to in location to the copy paper sheets of JIS B row size accommodated in the copy paper feeding cassette 8 and also to copy paper sheets of JIS A row size to be stored in another copy paper feeding cassette 272 to be described later. On the shaft 248, the sprocket wheel 148 is fixed, with the magnet clutch 146 being further mounted thereon. As mentioned previously, the shaft 248 is driven for rotation in the direction of arrow 252 by the action of the magnet clutch 146, whereby the top sheet of the copy paper sheets accommodated in the copy paper feeding cassette 8 is fed towards the copy paper transport path 56.

At a position in front of the copy paper feeding cassette 8, a shaft 254 is journalled in the side walls 234 and 236, and on the shaft 254, a push up lever 256 is rotatably mounted at a position corresponding to opening 226 of the cassette 8. To the push up lever 256, one end of a coil spring 258 is fixed and the other end of the spring to the shaft 254 is secured to lines 256, and the coil spring 258 urges the push up lever 256 in the direction indicated by arrow 260, i.e. biases the mounting plate 224 upwardly. The contacting portion 256*a* of the push up lever 256 is arranged to contact the projection 240 of the mounting plate 224. To the shaft 254, a pair of engaging levers 262 are fixed in spaced relation corresponding to the width of the copy paper feeding cassette 8, and the engaging levers 262 are to be fitted into the recesses 228 formed in the cassette 8.

To one end of the shaft 254 (the nearer side in FIG. 5), there is fixed a positioning member 264 having an approximately sector shape. To the side plate 234, a retaining pin 266 of fixed adjacent to an arcuate portion 264*a* formed at one end portion of the positioning member 264. Between the retaining pin 266 and the other end 264*b* of the positioning member 264, a tension spring 268 is connected. At the opposite ends in the circumferential direction of the arcuate portion 264*a*, there are formed a pair of projections 264*c* and 264*d* to be engaged with the retaining pin 266.

Figure 8:
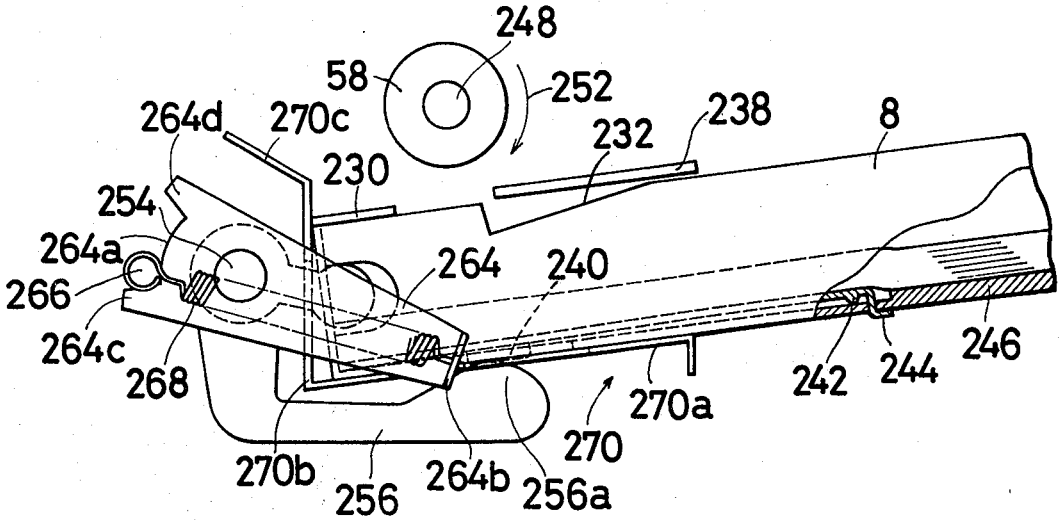
FIG. 8 is a front side view of FIG. 5 with a side plate omitted for clarity.

FIG. 8 is a front side view of FIG. 5, with the side plate 234 omitted for clarity. Referring to FIGS. 2 and 8, at the right end portion of the apparatus housing 2 in FIG. 2, a receiving member 270 for receiving the copy paper feeding cassette 8 is provided, and the receiving member 270 includes a cassette guide portion 270*a* which is inclined downwardly by a predetermined angle to extend into the interior of the apparatus housing 2 for guiding the bottom wall of the cassette 8, a contact portion 270*b* bent to extend from the forward edge of the cassette guide portion 270*a* for contact with the forward edge of the cassette 8, and a copy paper guide portion 270*c* to extend from the upper end of the contact portion 270*b* into the interior of the apparatus housing 2 so as to guide the copy paper sheets fed from the cassette 8 towards the copy paper transport path 56. The cassette guide portion 270*a* is formed with an opening (not shown) corresponding to the opening 226 of the cassette 8 so that the projection 240 of the mounting plate 224 can contact the push up lever 256.

For mounting the cassette 8 in the apparatus housing 2, the bottom wall of the cassette 8 is first inserted along the cassette guide portion 270*a* of the receiving member 270 until the front side wall 222*d* of the cassette 8 contacts the contact portion 270*b* to achieve the state as shown in FIG. 8. In the above case, the shaft 254 is in the rotating position where one of the projections 264*c* of the positioning member 264 engages the retaining pin 266. Under this state, the shaft 254 is being urged clockwise in FIG. 8 by the spring force of the tension spring 268, and the engaging levers 262 are fitted into the recesses 228 of the cassette 8 to be retained thereat. Therefore, the contact portion 256*a* of the push up lever 256 is brought into contact with the projection 240 so as to be locked in the state of FIG. 8.

Figure 9:
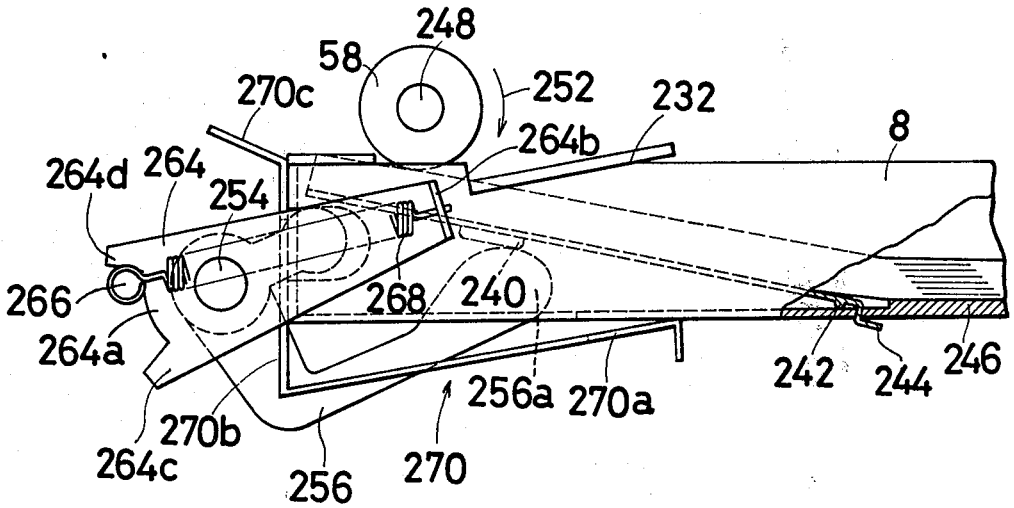
FIG. 9 is a front side view of FIG. 5 showing of the copy paper feeding cassette related with respect to FIG. 8.

Subsequently, the copy paper feeding cassette 8 is rotated as shown in FIG. 9 in a direction in which the forward end portion of the cassette 8 is moved upward about the rear edge of the cassette guide portion 270*a* of the receiving member 270. By the above procedure, the recesses 232 of the copy paper feeding cassette 8 are engaged with the retaining plates 238, and simultaneously with the stopping of the turning of the cassette 8, rearward (towards the right to FIG. 9) movement of the cassette 8 is prevented. By the above rotating operation of the copy paper feeding cassette 8, the shaft 254 and the positioning member 264 are rotated counterclockwise in FIG. 9, by 228 and 262 and after the most stretched state of the tension spring 268 is passed, are urged counterclockwise by the spring force of the tension spring 268. Accordingly, the positioning member 264 is rotated up to such a position that the other projection 264*d* thereof engages the retaining pin 266.

By the counterclockwise rotation of the shaft 254, the push up lever 256 is released from locking, whereby the push up lever 256 is rotated counterclockwise in FIG. 9 by the spring force of the coil spring 258 so as to push up the projection 240 of the mounting plate 224. Consequently, the forward end portion of the mounting plate 224 is pushed up or rotated in an inclined state as shown in FIG. 9 about the support projection 242, and thus, the top sheet of the stack of the copy paper mounted on the copy paper mounting plate 224 is pressed against the copy paper feeding roller 58, while opposite corners at the leading end of the top sheet of the copy paper mounted on the plate 224 are brought into contact with the engaging claws 230. When the copy paper feeding roller 58 is driven for rotation in the above state, the top copy paper sheet of the stack of copy paper sheets is fed foward along the copy paper guide portion 270*c* of the receiving member 270 so as to be supplied into the copy paper transport path 56. It is to be noted here that the length l2 (FIG. 6) of the mounting plate 224 is to be pushed up substantially in parallel relation by the rotation of the push up lever 256. By the above arrangement, variations in the positional angle of the top copy paper sheet with respect to the engaging claws 230 are advantageously prevented, and consequently, the top copy paper sheet is positively fed out only one sheet at a time.

The force at which the copy paper sheets are pressed with respect to the respective copy paper feeding rollers 58 at the left and right sides is adjusted to be approximately constant by the support projection 242 provided on the mounting plate 224. More specifically, on the assumption that the force towards the copy feeding rollers 58 is not constant when the mounting plate 224 is pushed upwardly by the pushing up action of the push up lever 256, since the support projection 242 is provided at the central position between the opposite side walls 222*b* and 222*c*, the mounting plate 224 is inclined towards the side pressed by a larger force with respect to the supporting point at the support projection 242 so as to be balanced at a position where the forces to the respective copy paper feeding rollers become equal, whereby the force to each of the copy paper feeding rollers 58 is maintained constant, and thus, a single sheet of the copy paper is positively fed.

For withdrawing the copy paper feeding cassette 8 from the apparatus housing 2 after all of the copy paper sheets in the cassette 8 have been used up, the cassette 8 is rotated from the state in FIG. 9 to the state shown in FIG. 8, whereby the notches 232 of the copy paper cassette 8 are disengaged from the retaining plates 238, and simultaneously, the engaging levers 262, and consequently the shaft 254 are rotated clockwise as shown in FIG. 9. Accordingly, the shaft 254 is returned to the rotational position shown in FIG. 8 where the one projection 264*c* of the positioning member 264 engages the retaining pin 266 by the spring force of the spring 268, while the copy paper push up lever 256 is rotated clockwise against the spring force of the coil spring 258 by the forward side plate 222*d* of the copy paper feeding cassette 8 so as to be returned to the position shown in FIG. 8. In the above state, the copy paper feeding cassette 8 is taken out by displacing the cassette 8 rearward (to the right side in FIG. 8).

The contact portion 256*a* of the push up lever 256 is formed in a convex arcuate shape upwardly in its cross section parallel to a vertical face along the transport direction of the copy paper sheet. By the above structure, eve in the state where the amount of loaded copy paper sheets is reduced and the push up lever 256 is rotated in the direction of the arrow 260, with the force of the spring 258 becoming small, it is possible for the top sheet of the copy paper to contact the copy paper feeding rollers 58 at proper pressure as compared with the case where such contact portion is flat without the convex arcuate face, and the copy paper sheets can be positively fed single sheet by single sheet. On the contrary, in a state where the loaded amount of the copy paper sheets is large, through an increase of the spring force of the spring 258, the top copy paper sheet can contact the copy paper feeding rollers 58 at a proper pressure for single sheet feeding.

In the mounting plate 224, by applying a sheet of hair-filled or flock friction material 286 only at a position immediately below the leftmost copy paper feeding roller 58 in FIG. 6, proper frictional force can be applied to the copy paper sheet, and thus, even when the amount of the loaded copy paper sheets is reduced, the copy paper sheets can be successfully fed single sheet by single sheet.

Figure 10:
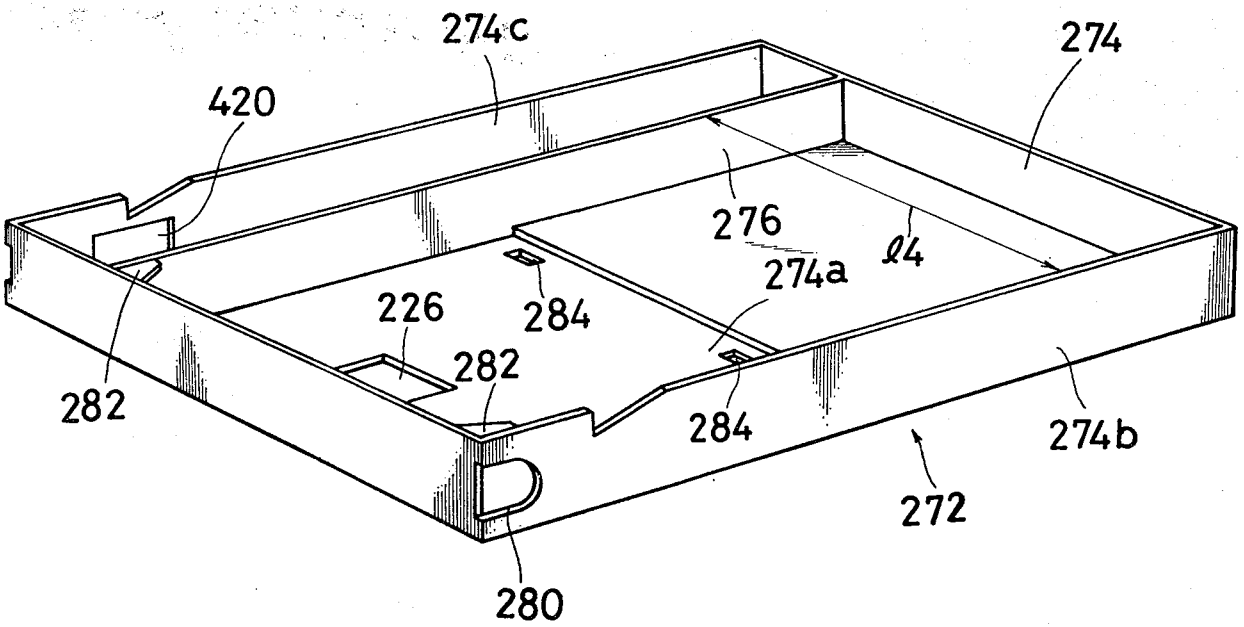
FIG. 10 is a perspective view of another copy paper feeding cassette.

Referring to FIG. 10 showing a perspective view of another copy paper feeding cassette 272, in which copy paper sheets of JIS A row size smaller in the width than those of JIS B row size are accommodated, cassette 272 includes a box-like rectangular container 274 of the same size as the container 222 of the copy paper feeding cassette 8 described earlier. At a distance corresponding to the width l4 of the copy paper sheet of JIS A row size from a side wall 274*b* of the container 274, a partition plate 276 is provided. A mounting plate abbreviated in FIG. 10 is to be accommodated between the side wall 274*b* and pertition plate 276. The above mounting plate includes a projection 278 (see FIG. 7), in a manner similar to projection 240 of the mounting plate 224 described earlier. The engaging pieces of the above mounting plate are to be fitted into engaging openings 284 formed in a bottom stepped portion 274*a* of the container 274 in a manner similar to that described earlier. Projection 278 is provided in a position intermediate between the side wall 274*b* and the partition wall 276. The length l3 of the projecting portion of the projection 278 is shorter than the length l1 of the projecting portion of the projection 240 for the copy paper feeding cassette 8 mentioned previously. Accordingly, the on force exerted to the copy paper feeding rollers 58 when the relatively small copy paper sheets of JIS A row size are accommodated in the cassette 272 is similar to that when copy paper sheets of JIS B row size housed housed in the copy paper feeding cassette 8. Therefore, copy paper sheets of JIS A row size which are smaller in size and consequently light in weight, and copy paper sheets which are larger in size and consequently heavier in weight can be brought into contact with the copy paper feeding rollers under a pressure best suited for feeding single sheets.

It is to be noted here that the push up lever 256 described as employed in the illustrated embodiment may be replaced by a push up member or the like having a different structure.

Referring again to FIGS. 1 and 2, the photosensitive drum 26 and developing device 32 and other devices are detachably mounted on a support member 290, which is reciprocatingly mounted in the forward and backward directions (i.e. in directions normal to the paper surface in FIG. 1) with respect to the apparatus housing 2.

Figure 11:
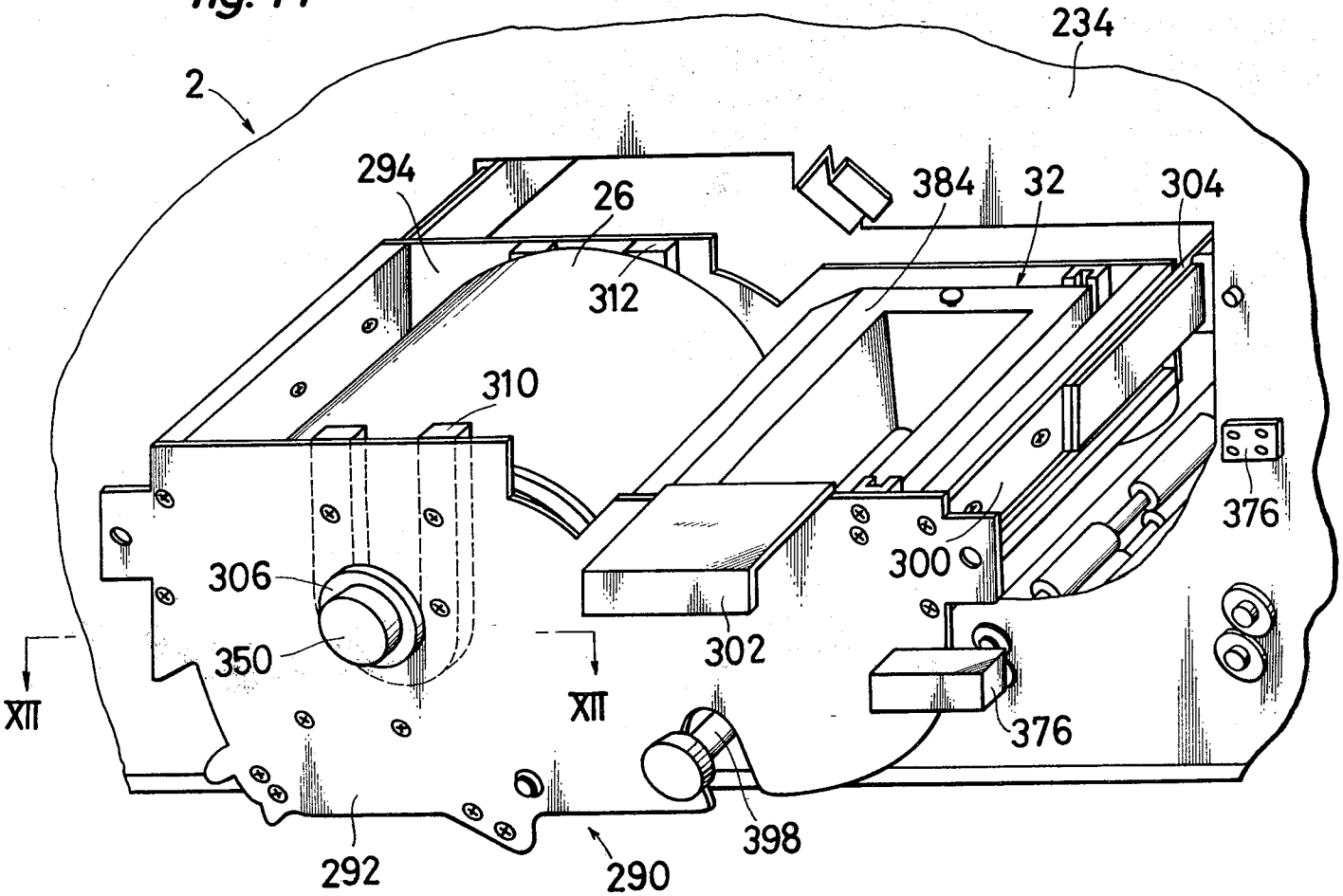
FIG. 11 is a perspective view illustrating a support member drawn out toward the forward side of the apparatus housing.

In FIG. 11 showing a perspective view illustrating the state where the support member 290 has been drawn out toward the forward side of the apparatus housing 2, the support member 290 includes front and rear side walls 292 and 294 disposed in parallel relation to each other with a predetermined interval therebetween and is guided by a rail member 300 for reciprocating sliding movement, while a handle piece 302 is secured to the side wall 292 of the support member 290.

Figure 12:
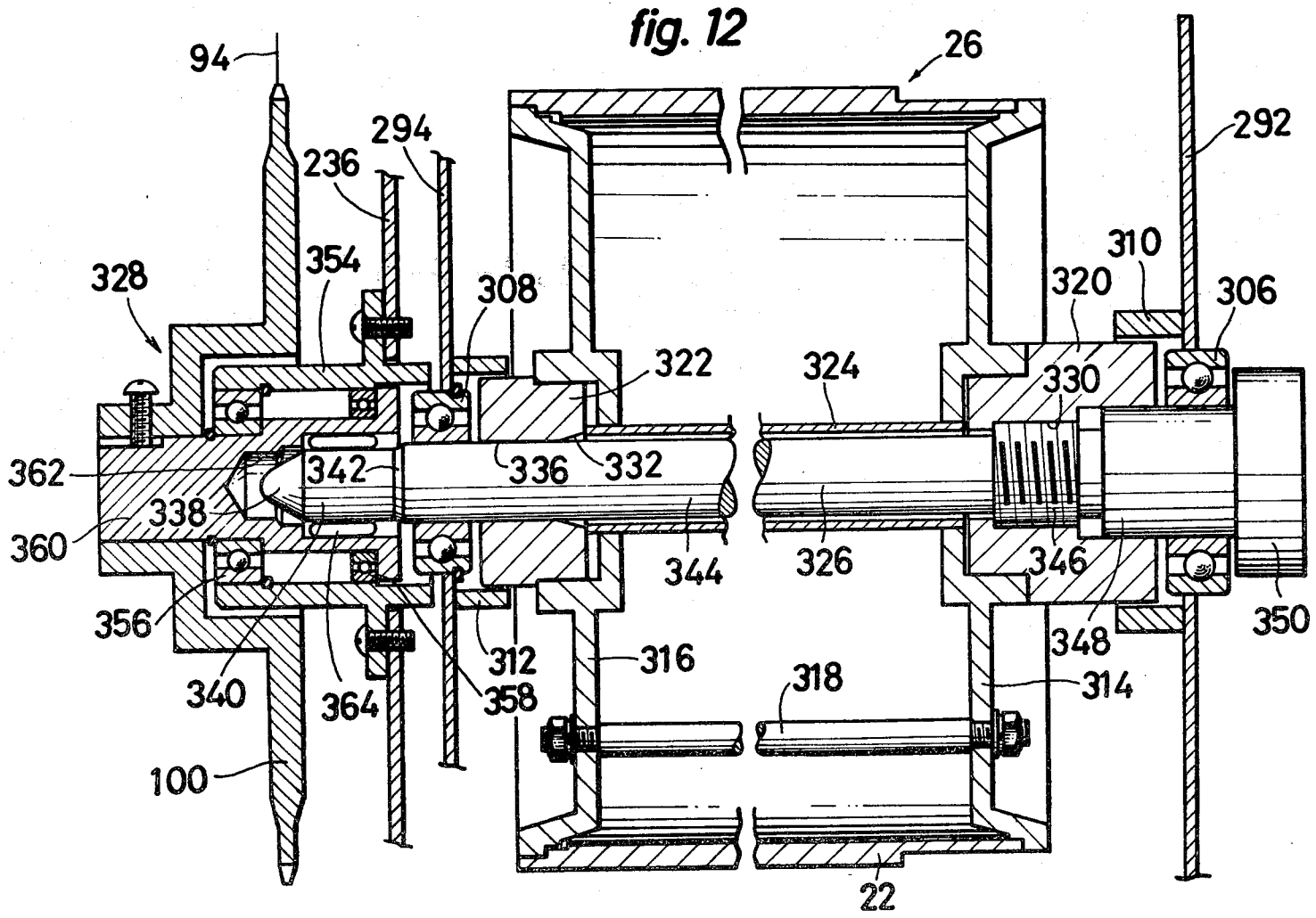
FIG. 12 is a cross section taken along the line XII—XII of FIG. 11.

Referring also to FIG. 12 showing a cross section taken along the line XII—XII of FIG. 11, bearings 306 and 308 having a common axis are respectively mounted on the side walls 292 and 294. On the confronting surfaces of the side walls 292 and 294 are fixed holder members 310 and 312, each having an approximately U-shaped holding face open at an upper portion thereof and positioned inwardly of the bearing 306 or 308. the inner side, are rigidly fixed. At opposite sides of a base structure of the photosensitive drum 26, end plates 314 and 316 are secured by a stay bolt 318. The end plates 314 and 316 are respectively provided with boss portions 320 and 322 having a common axis and extending outwardly from the base structure 22 in the direction of such axis. In the space between the boss portions 320 and 322, a guide tube 324 is coaxially fixed.

Figure 14:
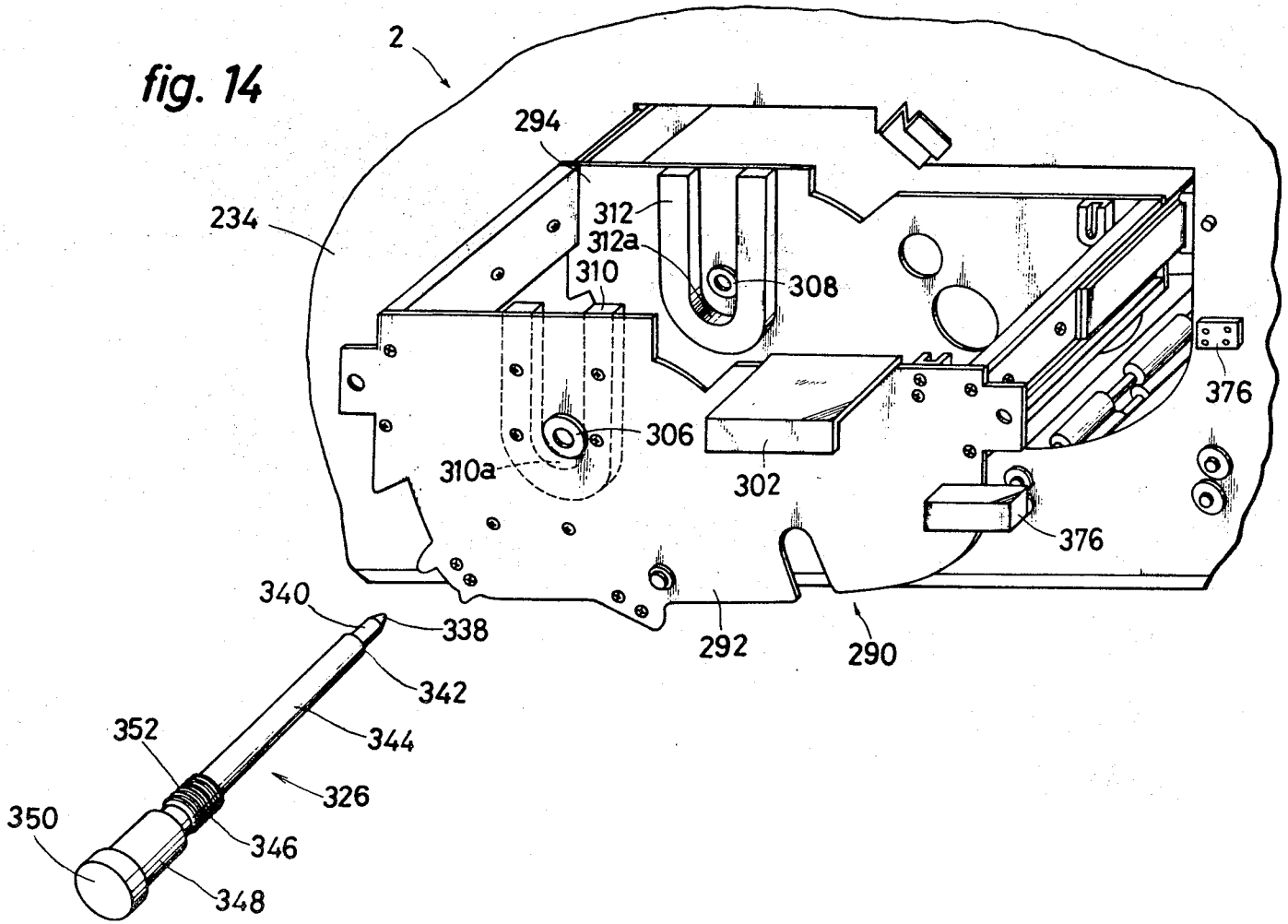
FIG. 14 is a simplified perspective view illustrating the support member.

Referring further to FIG. 14 showing a simplified perspective view illustrating the support member 290 and its vicinity, in the state where the photosensitive drum 26 is inserted from above into the U-shaped holding faces of the holder members 310 and 312, with the boss portions 320 and 322 contacting bottom portions 310*a* and 312*a*, the axis of the photosensitive drum 26 is located slightly below the axis of the bearings 306 and 308. The configurations of the boss portions 320 and 322 and the positions of the bottom portions 310*a* and 312*a* of the holder members 310 and 312 in upward, downward and horizontal directions are to be determined suit to the above arrangement. A rotary shaft 326 for supporting the photosensitive drum 26 through the bearings 306 and 308 sequentially extends through the bearing 306, boss portion 320, guide tube 324, boss portion 322 and bearing 308 as viewed from the side before the support member 290, and is coupled to a driving unit 328 provided in the apparatus housing 2. The inner peripheral surface of the boss portion 320 at the inserting side (i.e. the right side in FIG. 12) is internally threaded at 330, while, in the boss portion 322 at the projecting side (i.e. the left side in FIG. 12), a conical face 332 is extended to be narrowed toward the projecting side along the axis of the photosensitive drum 26, and a bearing face 336 is contiguous to conical face 332.

The rotary shaft 326 is formed with a tip portion 338, a reduced diameter portion 340, a conical portion 342, a large diameter portion 344, an externally threaded portion 346, another large diameter portion 348 and a knob 350 along its axis. The tip portion 338 is formed into an approximate conical shape towards the free end side. The externally threaded portion 346 engages the internal thread 330.

On the other hand, the driving unit 328 includes a cylindrical holding member 354 secured to the side wall 236 of the apparatus housing 2, a driving shaft 360 rotatably fitted into the holding member 354 through bearings 356 and 358, and a sprocket wheel 100 fixed to the outer periphery of the driving shaft 360. The driving shaft 360 is formed with an engaging hole 362 open towards the inserting side. Into the engaging hole 362, the tip portion 338 and small diameter portion 340 of the rotary shaft 326 are fitted through a one-way clutch 364 as a shaft coupling. The holding member 354, driving shaft 360, sprocket wheel 100 and engaging hole 362 have a common axis. The sprocket wheel 100 is connected to the motor 88 (see FIG. 3) provided in the apparatus housing 2 through the chain 94.

Figure 13:
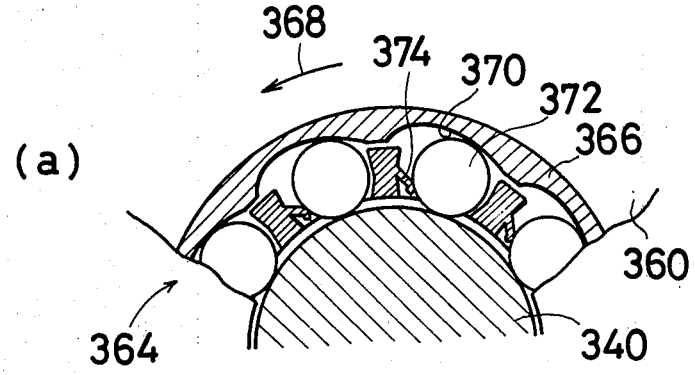
FIGS. 13(*a*) and 13(*b*) are fragmentary cross sections of part of a one way clutch on an enlarged scale.
Figure 13:
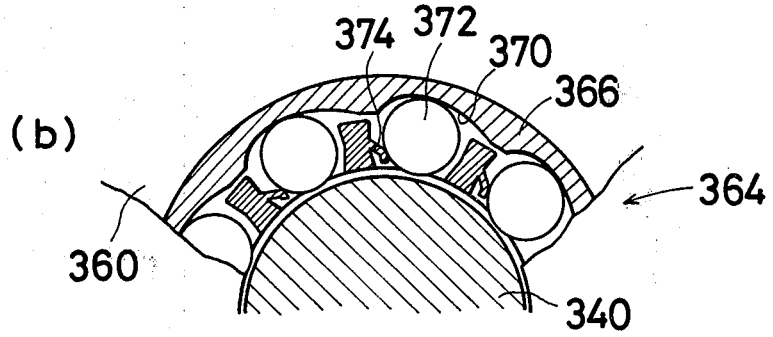

Referring also to FIG. 13 showing fragmentary cross sections of part of the one-way clutch 364 on an enlarged scale, an input end member 366 is fixed to a driving shaft 360. The input end member 366 has a plurality of recesses radially formed in spaced relation from each other in the circumferential direction and respectively provided with surfaces 370 inclined in directions away from the rotary shaft radially outwardly towards the rotational direction 368. Between each of the inclined surfaces 370 and the peripheral surface of the small diameter portion 340, a roller 372 is disposed. Moreover, springs 374 are provided to impart a biasing force to the rollers 372 opposite to the rotating direction 368.

Upon rotation of the driving shaft 360 and input end member 366 in the rotational driving direction 368, each of the rollers 372 enters between the inclined surface 370 and the peripheral surface of the small diameter portion 340 along inclined surface 370 through the resiliency of the spring 374 as shown in FIG. 13 (*a*). Consequently, the rotational driving force from the input end member 366 is transmitted to the small diameter portion 340 through the rollers 372, and the rotary shaft 326 is driven for rotation together with the driving shaft 360 as one unit. By the rotation of the rotary shaft 326 as described above, the photosensitive drum 26 is caused to rotate. When the driving shaft and consequently, the input end member 366 remains stationary, shown in FIG. 13 (*b*), the rollers 372 never enter between and in contact with the inclined surfaces 370 and the peripheral surface of the rotary shaft 326.

For mounting the photosensitive drum 26 onto the apparatus housing 2, with the support member 290 drawn out of the housing 2, the boss portions 320 and 322 of the photosensitive drum 26 are first fitted into the U-shaped holding faces of the holder members 310 and 312 to support the boss portions 320 and 322 at the bottom portions 310*a* and 312*a* of the holder members 310 and 312. Subsequently, the rotary shaft 326 is sequentially passed from the front side through the bearing 306, boss portion 320, guide tube 324 and boss portion 322. In the above case, the tip portion 338 of the rotary shaft 326 can smoothly fitted from the guide tube 324 into the bearing face 336 of the boss portion 322 through the conical face 332 of the boss portion 322.

In the next step, the internal thread 330 of the boss portion 320 is engaged with the externally threaded portion 346 of the rotary shaft 326 by rotating the knob 350, and the rotary shaft 326 is threadingly advanced toward the projected side (left hand side in FIG. 12), whereby the tip portion 338 of the rotary shaft 326 is smoothly fitted into the bearing 308. Furthermore, since the conical portion 342 contiguous to the small diameter portion 340 of the rotary shaft 326 is provided, the large diameter portion 344 is smoothly fitted into the bearing 308 as the rotary shaft 326 is advanced. In the above manner, the tip portion 338 and small diameter portion 340 of the rotary shaft 326 are projected outwardly in the axial direction from the bearing 308, and the photosensitive drum 26 is mounted on the support member 290.

Subsequently, the support member 290 on which the photosensitive drum 26 is mounted is pushed into the apparatus housing 2, and thus, the small diameter portion 340 of the rotary shaft 326 extending outwardly from the bearing 308 is fitted into the one way clutch 364 provided in the engaging hole 362 of the driving shaft 360. Since the tip portion 338 of the rotary shaft 326 is formed in a conical shape, the small diameter portion 340 of the rotary shaft 326 can be smoothly fitted into the one way clutch 364.

The direction of the threads 330 and 346 is in the direction for mutual tightening during the copying rotation in the direction of the arrow 368. Therefore, even when the photosensitive drum 26 is mounted in the state where the threads 330 and 346 are loosened, the photosensitive drum 26 and rotary shaft 326 are connected to be one unit by the copying operation. It is to be noted here that the above arrangement may be modified in such a manner that, with an internal thread provided on the boss portion 322, an external thread engageable with the internal thread is formed on the rotary shaft 326.

Developing Device

Figure 15:
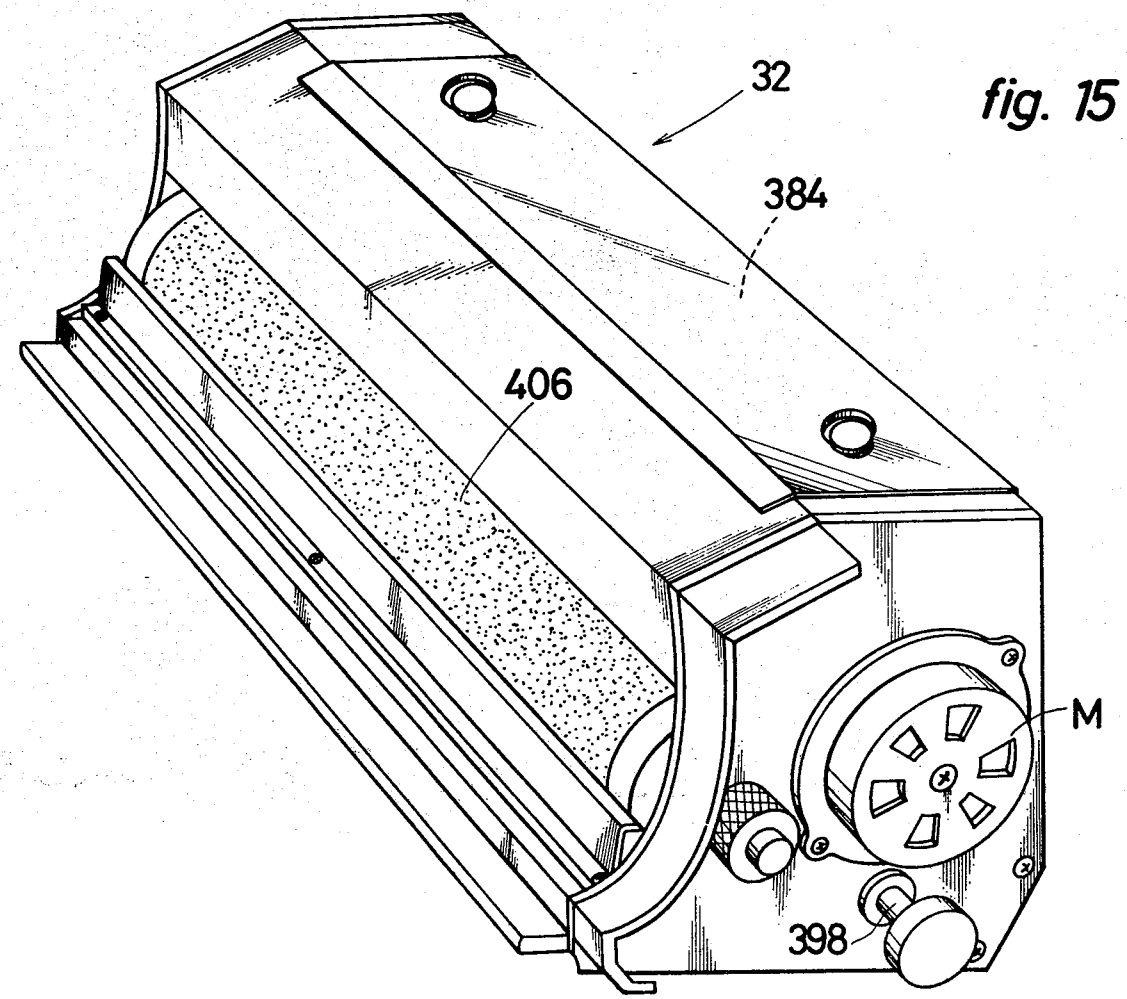
FIG. 15 is a perspective view of a developing device.
Figure 16:
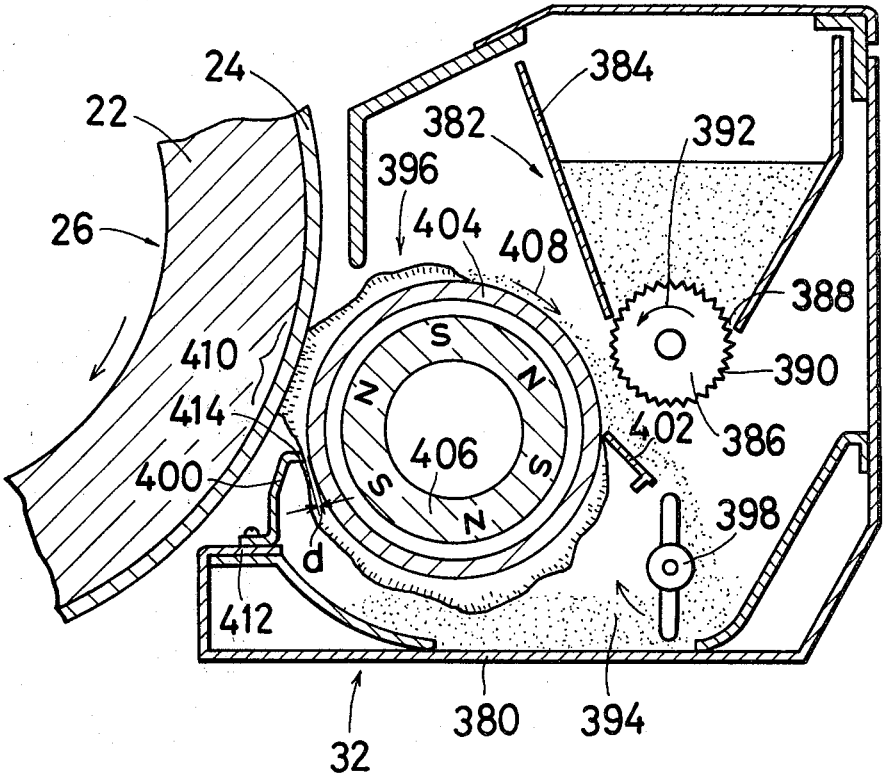
FIG. 16 is a cross section of the developing device of FIG. 15 on an enlarged scale.

Referring to FIG. 15 showing a perspective view of the developing device 32 and also to FIG. 16 showing a cross section thereof on an enlarged scale, the developing device 32 includes a developing container 380, on the upper portion of which there is provided a toner supplying device 382. The toner supplying device 382 includes a toner supplying container 384 and a toner supplying means, for example, a toner supplying roller 386. The developing device 32 is detachable from the support member 290. The toner supplying roller 386 is rotatably provided at an opening 388 formed at the lower portion of the toner supplying container 384 and is provided, at its outer periphery, with a plurality of grooves 390 extending along the axis thereof. The supplying roller 386 is driven by an electrical driving device, for example, by a motor M to be mentioned later. The motor M secured to the toner supplying container 384 has its output shaft directly connected to the toner supplying roller 386. Since the motor M is wired by the use of a detachable connector 376, it is only necessary to disconnect the connector 376 when the developing device 32 is to be removed from the support member 290.

When the toner supplying roller 386 is, for example, rotated counterclockwise in FIG. 16 as shown by the solid line arrow 392, the toner filled in the grooves 390 of the toner supplying roller 386 is supplied into a sump 394 formed at the lower portion of the developing container 380. In the state where the toner supplying roller 386 is stopped rotating, the supply of the toner is interrupted. The motor M for driving the toner supplying roller 386 is controlled by a control circuit shown in FIG. 17 mentioned later, by which the rotational angle of the toner supplying roller 386, and consequently, the amount of toner to be supplied into the toner sump 394 is adjusted.

Within the developing container 380, there are provided a magnetic brush mechanism 396, a stirring device 398, a magnetic brush height adjusting member 400 and a guide member 402 as shown. In the sump 394, a dual component or two component developing material composed of toner and magnetizable carrier is stored. As the dual component developing material is agitated by the stirring device 398, the toner and carrier are uniformly mixed. The guide member 402 leads the toner from the toner supplying device 382 to the stirring device 398.

The magnetic brush mechanism 396 provided in a position adjacent to the photosensitive layer 24 on the outer periphery of the photosensitive drum 26 includes a hollow rotary developing sleeve 404 made of strong magnetic material and having an axis parallel to the photosensitive drum 26, and a permanent magnet member 406 fixedly provided within the developing sleeve 404. As the developing sleeve 404 is rotated clockwise in FIG. 16 as indicated by the solid line arrow 408, the dual component developing material in the sump 394 is held on the peripheral surface of the developing sleeve 404 and transported to the developing position 410, whereat a magnetic brush having magnetic bristles with high density and uniform height erected from the outer periphery of the developing sleeve 404 is formed, and thus, close and positive contact between the magnetic brush and the photosensitive layer 24 formed with the electrostatic latent image thereon is effected, whereby the electrostatic latent image formed on photosensitive layer 24 is developed by the toner. The dual component developing material after completion of the developing operation is restricted on the outer periphery of the developing sleeve 404 and is moved from the developing position 410 in the direction of the arrow 408, and at a position remote from the developing position 410 with respect to the axis of the developing sleeve 404, the dual component developing material is detached from the peripheral surface of the developing sleeve 404, and guided by the guide member 402 so as to be dropped into the sump 394.

The magnetic brush height adjusting member 400 is disposed adjacent to the peripheral surface of the developing sleeve 404 at an immediate upstream side of the developing position 410 along the rotational direction 408 of the developing sleeve 404. The magnetic brush height adjusting member 400 is arranged to be movable in a direction perpendicular (leftward and rightward in FIG. 16) to the axis of the developing sleeve 404 along a horizontal support seat 412 provided on the bottom face of the developing container 380. By moving the magnetic brush height adjusting member 400 along the support seat 412, it is possible to adjust a distance d between the top 414 of the magnetic brush height adjusting member 400 and the peripheral surface of the developing sleeve 404. By properly adjusting the above distance d, the magnetizable carrier which provided magnetic bristles of uniform height and density at the developing position 410 and a proper amount of toner can be stably fed to the developing position 410.

Reffering back to FIG. 5, in the state where the copy paper feeding cassette 8 for accommodating therein the copy paper sheets of JIS B row size is positioned as shown, the side wall 222*c* of the copy paper feeding cassette 8 is depressing an actuator 418 of a detection switch 416 mounted on the rear side wall 236, and this detection switch 416 is in the OFF state when the actuator 418 is depressed.

Referring back also to FIG. 10, in the side wall 274*c* of the copy paper feeding cassette 272 for accommodating therein the copy paper sheets of JIS A row size, through-hole 420 is formed at a position facing the detection switch 416 when the copy paper feeding cassette 272 is mounted on the apparatus housing 2. Therefore, the actuator 418 of the detection switch 416 is not depressed and the switch 416 is in the conducting state.

The detection switch 416 is in the OFF state by the copy paper feeding cassette 8 accommodating therein the copy paper sheets of JIS B row size, while it is in the conducting state by the copy paper feeding cassette 272 accommodating therein the copy paper sheets of JIS A row size as described above. Accordingly, the widths of the copy paper sheets can be detected by the detection switch 416.

Figure 17:
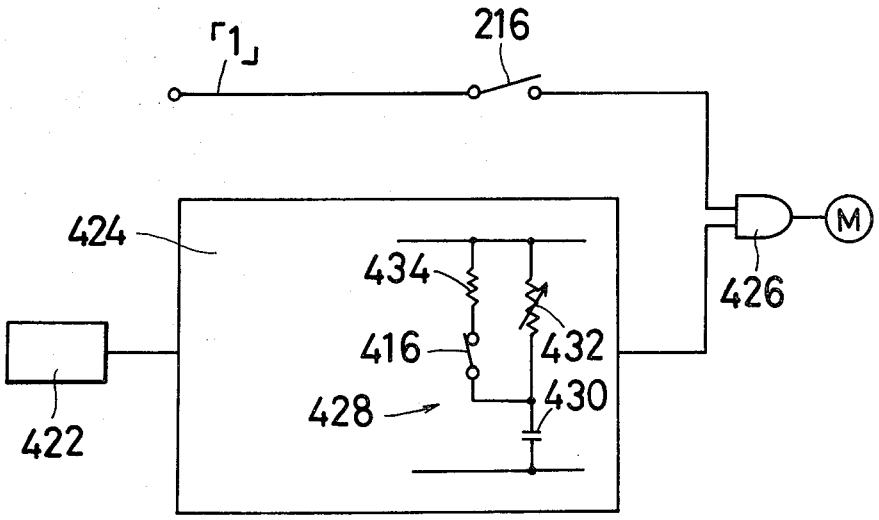
FIG. 17 is a wiring diagram of an electric circuit for control of a motor M for rotating the toner supplying roller.
Figure 18:
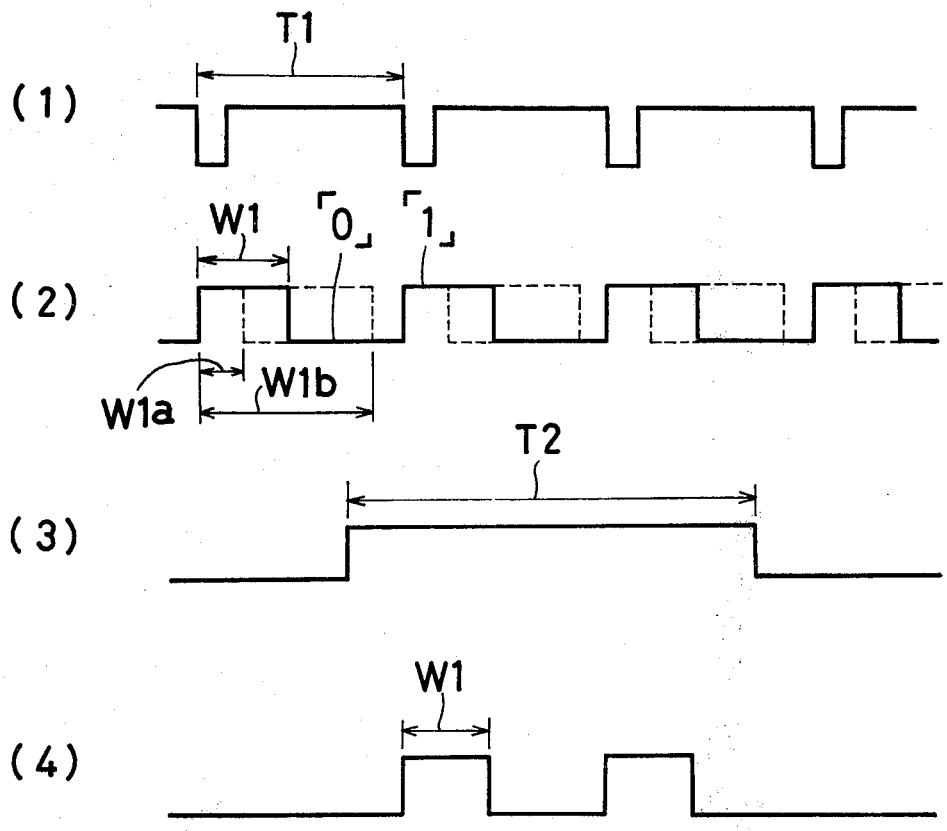
FIG. 18 illustrates wave-form of the electric circuit of FIG. 17.

Referring to FIG. 17 showing a control circuit for controlling a motor M such as a pulse motor for rotating the toner supplying roller 366, a non-stable circuit 422 is in the oscillating function at all times by closing the power supply of the copying apparatus, and is arranged to produce pulses having a period T1 as shown in FIG. 18(1) to be fed to a mono-stable circuit 424, in which an output pulse width W1 from the non-stable circuit 422 is reduced.

When the copy paper sheets are of JIS A row size with the smaller copy width than JIS B row size, the detection switch 416 is on and thus the composed resistance of a variable resistor 432 and a resistor 434 is reduced. This results in the pulse width W1 becoming small since the time constant of time constant circuit 428 of mono-stable circuit 424 becomes small.

When the copy paper sheets are of JIS B row size with the large copy paper width, the detection switch 416 remains cut off, and therefore, the time constant to be determined by the resistance value of variable resistor 432 is comparatively large, with a consequent large pulse width W1.

As described above, the output pulse from the mono-stable circuit 424 is varied according to the widths of the copy paper sheets. The pulse width W1 is variable in the range from W1a to W1b as shown, for example, in FIG. 18(2).

To the other input terminal of an AND gate 426, a signal of logic "1" is applied through the detection switch 216. The actuator 436 (see FIG. 2) of the detection switch 216 is kept depressed only for a time period T2 during which the copy paper sheet passes through the position of the actuator 436. Therefore, the detection switch 216 is kept conducting for the time period during which the copy paper passes, and this conducting time T2 corresponds to the length of the copy paper sheet. Accordingly, the signal to be given to the other input terminal of the AND gate 426 is, for example, as shown in FIG. 18 (3).

When the copy paper sheet is, for example, JIS B row size with a large width, a case where the signal to be applied to one input terminal of the AND gate 426 has a waveform as shown in a solid line of FIG. 18 (2) is assumed. In the above case, the signal applied to the other input terminal of the AND gate 426 has a waveform as shown in FIG. 18 (3), and therefore, the output signal from the AND gate 426 has a waveform as shown in FIG. 18 (4). By this output signal from the AND gate 426, the motor M functions only for each period of the pulse width W1. Consequently, the toner supplying roller 386 is subjected to angular displacement by a rotational angle corresponding to the pulse width W1, and the toner is supplied into the sump 394 by an amount corresponding to the rotational angle of the toner supplying roller 386.

In short, the pulse width W1 is respectively determined to be small or large according to small or large widths of the copy paper sheets. Meanwhile, the conducting time T2 of the detection switch 216 and consequently, the number of the output pulses having the pulse width W1 from the AND gate 426 is determined to be larger or smaller according to the lengths of the copy paper sheets. In other words, the motor M is actuated at each output pulse from the AND gate 426 having the pulse width W1 during the period of the passing time T2 for the copy paper sheet, and thus, the toner supplying roller 386 is rotated. Consequently, the toner supplying roller 386 is driven for large rotational angles in the case of the large copy paper sheets and for small rotational angles in the case of the small copy paper sheets, and thus, the toner supplying amount is controlled according to the sizes of the copy paper sheets.

It is to be noted here that, in the foregoing embodiment, although the detection switch 216 is maintained to be conducting for time periods corresponding to the lengths of the copy paper sheets, detection switch 216 may be so arranged as to be made conductive at each copying process or at every predetermined number of copying processes for a predetermined period of time in other modifications.

In further possible modifications, the toner supplying roller 386 described as employed in the foregoing embodiment may be replaced by a screw feeder or the like provided at the lower portion of the toner supplying container 384. Moreover, a slit may be formed at the lower portion of the toner supplying container 384 so as to adjust the width thereof. In the above case, as a driving device for adjusting the slit width, a magnet valve may be employed instead of the motor M.

Heating and Fixing Device

Figure 19:
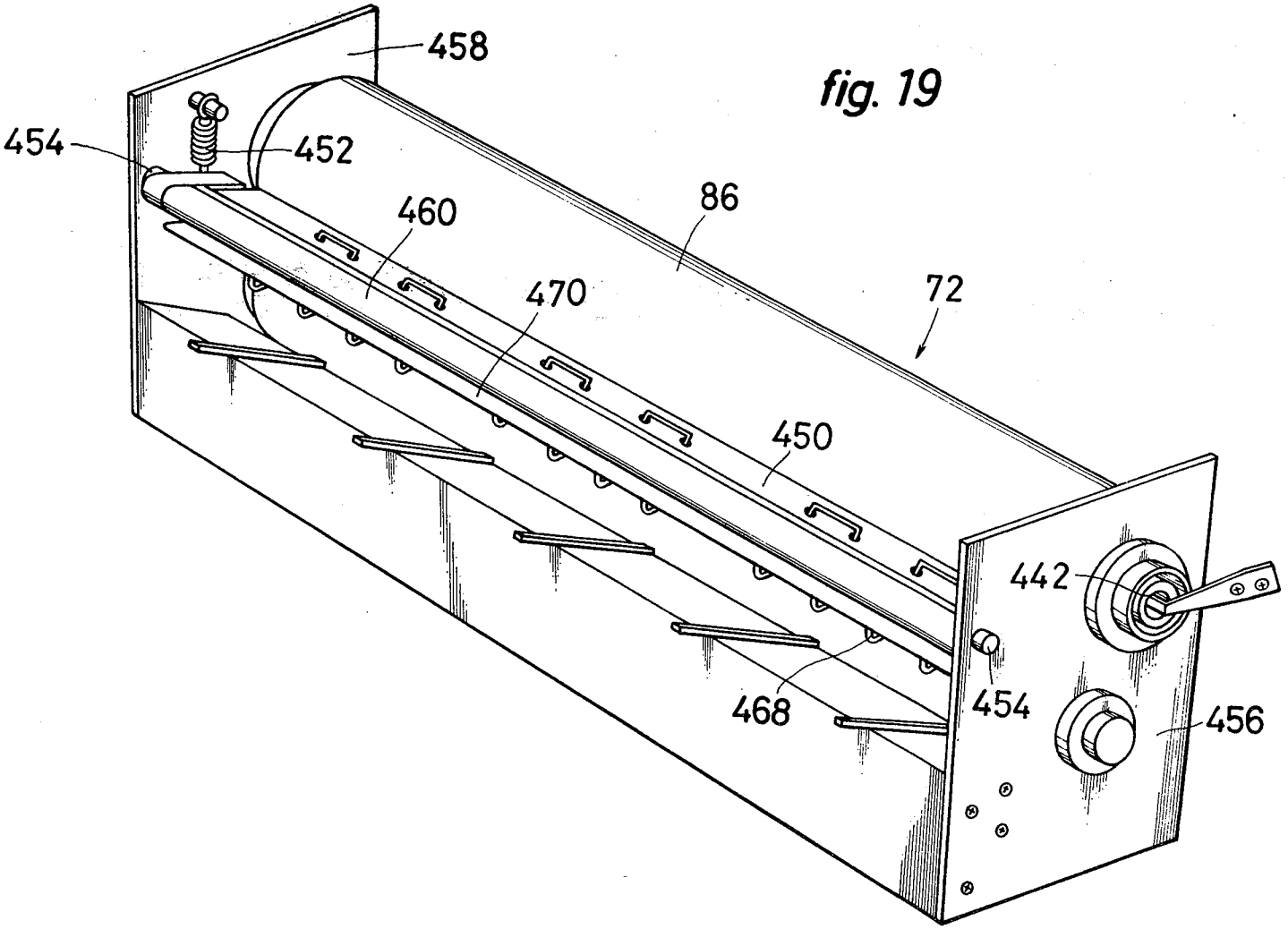
FIG. 19 is a perspective view of a heating and fixing device.
Figure 20:
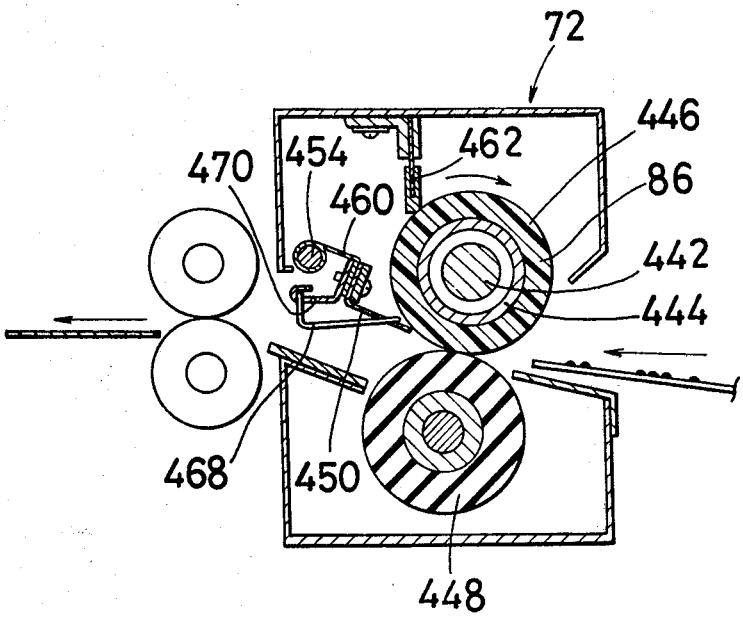
FIG. 20 is a cross section of the heating and fixing device of FIG. 19.

Referring now to FIG. 19 showing a perspective view of the heating and fixing device 72 and also to FIG. 20 showing a cross section thereof, the fixing roller 86 of the heating and fixing device 72 is driven for rotation by the motor 88 during the copying operation as described earlier, and is slowly rotated by the auxiliary motor 166 at times other than during the copying operation. The fixing roller 86 has a heater 442, and a coating 446 having favorable peel-off property and heat resistance, e.g. Teflon, is coated on a metal tube 444 surrounding the heater 442. Below the fixing roller 86, a pressure roller 448 following the rotation of the fixing roller 86 is rotatably mounted on the apparatus housing 2. Around the outer periphery of the pressure roller 448 is applied rubber material having heat resistance and abrasion resistance. When the copy paper sheet bearing the toner image is passed between the fixing roller 86 and pressure roller 448, the toner image is fused onto the copy paper sheet for being fixed thereon.

For preventing the so-called offset phenomenon in which the toner on the copy paper sheet adheres to the surface of the fixing roller 86 so as to be fused onto subsequent copy paper sheets and the undersirable winding of the copy paper sheet onto the fixing roller 86, there is provided a blade 450 made of materials having favorable heat resistance and abrasion resistance, for example, made of resilient steel plate at the discharge side of the fixing roller 86. The forward edge of the blade 450 is arranged to elastically contact under pressure the Teflon coating 446 by a spring 452, and is formed into a thin plate-like shape of less than 0.1 mm for scraping off the adhering toner from the fixing roller 86 and also for peeling off the wound copy paper sheet. Furthermore, for protecting the Teflon coating 446 from being damaged by the blade 450, the forward edge of the blade 450 contacting the Teflon coating 446 is formed to be smoothly curved as shown on an enlarged scale in FIG. 21. The opposite ends of a shaft 454 are journalled in frame plates 456 and 458 of the heating and fixing device 72. By making the blade 450 as a resilient steel plate, such an advantage is obtained that the blade 450 is superior in heat resistance and abrasion resistance, and is so firm as will not be readily deformed. To the shaft 454 is secured a base plate 460 urged by a spring 452, while the blade 450 is fixed to the base plate 460.

Furthermore, for maintaining the surface of the Teflon coating 446 still cleaner, it may be so arranged that a cleaning member 462 slidingly contacts the Teflon coating 446 in a forward position with respect to the blade 450 in the rotational direction.

Figure 21:
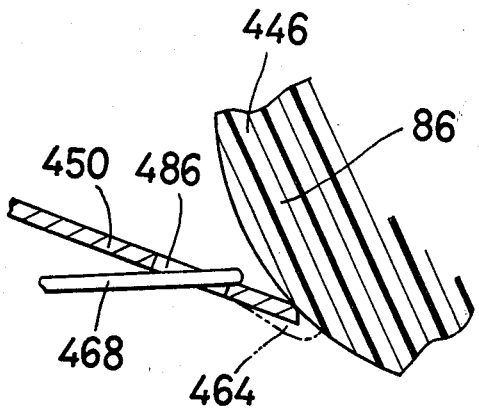
FIG. 21 is an enlarged view of the fixing roller of FIG. 20.

When the toner adhering to the outer periphery of the fixing roller 86 is scraped off by the forward edge of the blade 450, the toner 464 tends to remain in a fused state on the under surface of the blade 450 as shown in FIG. 21, and if the leading edge of the next copy paper sheet contacts the toner 464, the copy paper sheet may be extensively soiled or it may not be transported, thus giving rise to copy paper jamming. For preventing the above inconveniences, a plurality of guide members 468 are provided in spaced relation from each other in the widthwise direction of the copy paper transport path.

Figure 22:
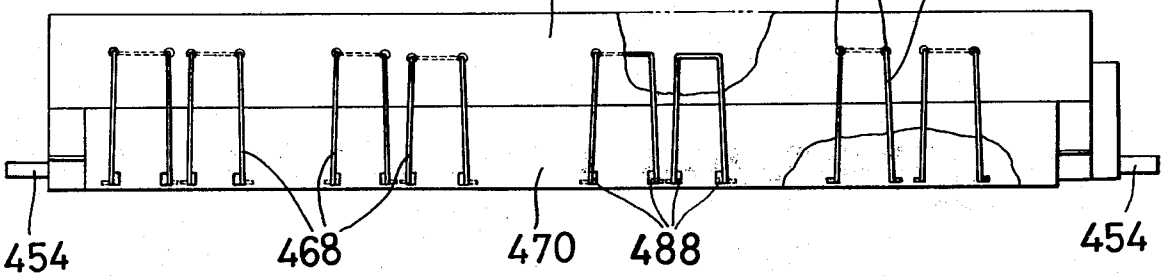
FIG. 22 is a bottom view of a blade 450 of FIG. 20.
Figure 23:
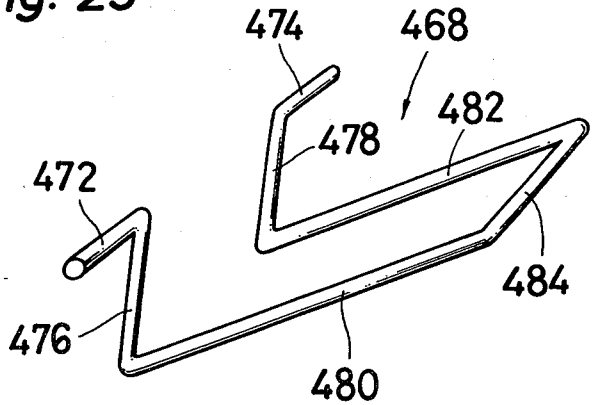
FIG. 23 is a perspective view of a guide member of FIG. 20 on an enlarged scale.

Referring to FIG. 22 showing a bottom view of the blade 450 and its vicinity as observed from below, and also to FIG. 23 showing a perspective view of a guide member 468 on an enlarged scale, a fixing member 470 is secured to base plate 460. The guide member 468 which is symmetrical in the direction of the copy paper transportation includes a bent portion 484, guide portions 480 and 482 extending in one direction from the bent portion 484, depending portions 476 and 478 respectively extending from the guide portions 480 and 482 at an angle, and engaging portions 472 and 474 respectively extending laterally from the depending portions 476 and 478 in directions away from each other. The opposite ends of the bent portion 484 are respectively extended through a pair of engaging openings 486 formed in the vicinity of the forward edge of the blade 450. The engaging portions 472 and 474 engage corresponding engaging openings 488 formed in the fixing member 470.

Accordingly, even if a large amount of the toner 464 remains on the under surface of the blade 450 and the copy paper sheet contact such toner 464, the copy paper can be further transported along the guide portions 480 and 482 of the guide member 468, and moreover, the soiling of the copy paper sheet due to adhesion of the toner 464 can be suppressed as far as possible.

In another possible embodiment of the invention, the photosensitive drum 26 may be replaced by a photosensitive member in which a flexible photosensitive layer is formed on the outer periphery of a flexible endless belt. In the foregoing embodiment aforementioned, the control of the exposure, developing, transfer and transportation of the copy paper sheet is effected on the basis of the movement of the moving member 130 through running of the chain 94, and in the above case, since the photosensitive layer 24 of the photosensitive drum 26 is formed along the entire peripheral surface in the circumferential direction thereof, even if the running position of the moving member 130 is deviated from the position of rotational angle of the photosensitive drum 26, the exposure and consequently the development and transfer can be positively effected, and the above state similarly applies to the case where the photosensitive drum 26 is replaced by the above described photosensitive member in the shape of the endless belt having the photosensitive layer formed on its entire outer periphery. In the case where the control of the exposure, developing, transfer and transportation of the copy paper sheets is to be effected based on the moving positions of the photosensitive drum 26 or endless belt, the rotational positions of the photosensitive layer can be correctly established, and therefore, the photosensitive layer may be provided only on a predetermined range in the circumferential direction thereof, and is not necessarily required to be provided along the entire peripheral surface in the circumferential direction.

It should also be noted that, as a still further possible embodiment, the invention may readily be applicable to an electrostatic copying apparatus of a type in which the electrostatic latent image formed on the photosensitive layer 24 is first transferred onto the copy paper as transfer paper, and then the electrostatic latent image thus transferred onto the transfer paper is developed by the toner. In the above case, the cleaning means also has a function to remove the electrical charge remaining on the photosensitive layer 24 after the transfer.

As is clear from the foregoing description, according to the invention, since it is so arranged that the portion of the photosensitive member subjected to cleaning reaches the exposure zone before or simultaneously with the arrival of the movable portion of the optical system or original document mounting table or original carrier at the exposure starting position from the home or initial position, not only clear and definite copied images are available due to the cleaning operation, but the time required for the copying operation is appreciably reduced as compared with the prior art aforementioned, particularly owing to the arrangement that the movable portion of the optical system or original document mounting table starts movement at the same time as the initiation of the copying operation, and that the copying process is completed before it is returned to the home or initial position. Furthermore, regarding the timing for starting the copy paper transportation, a similar functioning state may apply even to the case where a plurality of copying processes are to be continuously effected, and therefore, the arrangement of the control thereof can be much simplified. Moreover, at the earlier stage at which the movable portion of the optical system or the original document mounting table starts moving, the photosensitive member is subjected to the exposure process as in the prior art. Thus, since the exposure process in the present invention is to be effected when the movable portion of the optical system or the original document mounting table is running stably, the electrostatic latent image obtained by the exposure is clear and definite and free from undesirable blurs.

What is claimed is:

1. In a transfer type electrostatic copying apparatus of the type comprising a cylindrical drum and a photosensitive layer provided on a peripheral surface of said drum, means for rotating said drum, a support for an original document to be copied, an optical system for illuminating the original document and for exposing a light image thereof onto said photosensitive layer, and one of said support and said optical system including a movable portion movable in a first direction from a home first position to a second position and movable in a second direction opposite to said first direction from said second position to said home first position, the improvement comprising:

an endless member entrained around first and second wheels to have first and second parallel linear runs, one of said wheels being rotated such that said endless member moves in an endless path around said wheels and along said linear runs;

said endless member having fixed thereto a first engaging member movable with said endless member in said endless path;

a second engaging member fixed to said movable portion;

connecting means for permanently connecting said first engaging member to said second engaging member in a manner to prevent relative movement therebetween in directions parallel to said linear runs and to allow relative movement therebetween in directions transverse to said linear runs by a distance at least equal to the spacing between said linear runs, and for thereby causing said endless member and said engaging members to move said movable portion in said first direction when said first engaging member is in said first linear run and to move said movable portion is said second direction when said first engaging member is in said second linear run;

said first engaging member being located at a position at the outer periphery of said first wheel and furthest spaced from said second wheel when said movable portion is at said home first position thereof;

cleaning means, positioned adjacent said photosensitive layer, for cleaning the outer surface of said photosensitive layer when said movable portion moves in said first direction from said home first position;

means for initiating and completing said exposing of said light image onto said photosensitive layer when said movable portion moves in said second direction back to said home first position;

means for synchronizing the speed of said movable portion in said second direction to be equal to the speed of said outer surface of said photosensitive layer;

a pair of bearings having a common axis and mounted on side walls on opposite sides of said photosensitive drum in the direction of the axis thereof, the inner diameter of one said bearing being larger than that of the other said bearing;

a rotary shaft having a tip portion formed into an approximate conical shape, said shaft extending through said drum and being supported by said bearings; and coupling means for transmitting driving force to said rotary shaft and positioned on the side of said photosensitive drum opposite the side thereof into which said shaft is inserted, said drum having extending outwardly from opposite sides thereof bosses fitting into open upper ends of holder members rigidly fixed to said side walls.

2. The improvement claimed in claim 1, wherein a photosensitive layer is formed continuously on the entire peripheral surface of said cylindrical drum, and further comprising control means for controlling the copying operation in accordance with movement of said movable portion.

3. The improvement claimed in claim 1, further comprising a housing, a plurality of cassettes capable of selectively being mounted in and withdrawn from said housing, each said cassette having a mounting plate for mounting stacked copy paper sheets, a trailing portion of said mounting plate being pivotable about an axis intersecting at a right angle with a copy paper feeding direction, a pair of engaging claws in said cassette for contacting forward side ends of a top sheet of the copy paper sheets, a copy paper feeding foller rotatably journalled above said cassette at a stationary position of said housing, a push up member mounted in a spring-biased manner for pushing said mounting plate upwardly to allow said top sheet to contact said copy paper feeding roller, and said mounting plate having a projection depending therefrom at a position contacting said push up member.

4. The improvement claimed in claim 3, wherein said projection is provided at the center of said mounting plane between said pair of engaging claws.

5. The improvement claimed in claim 3, further comprising a support projection at a trailing portion of said mounting plate at a central position between said pair of engaging claws.

6. The improvement claimed in claim 1, wherein one of said bosses has an internal thread formed on the inner surface thereof and engaging an external thread formed on said rotary shaft, the direction of said threads being in a direction for mutual tightening during copying rotation.

7. The improvement claimed in claim 6, wherein said coupling means comprises a one-way clutch having a plurality of circumferentially spaced rollers, and an input end member having 2 plurality of radial recesses provided with surfaces inclined in directions away from said rotary shaft and in the rotational direction, a rotational driving force from said input end member being transmitted to said rotary shaft by said rollers engaging between said inclined surfaces and the periphery of said rotary shaft.

8. The improvement claimed in claim 1, further comprising a heating and fixing device for fusing a toner image onto a copy paper sheet and including a fixing roller provided with a heater and a pressure roller, a blade having a forward edge elastically contacting under pressure said fixing roller at a discharge side of said rollers, a plurality of guide members mounted on said blade and extending downwardly therefrom along the feeding direction of the copy paper sheet in spaced relation from each other in the widthwise direction of the copy paper transport path.

9. A mounting arrangement for removably mounting a phosotsensitve drum in a housing of a transfer type electrostatic copying apparatus, said arrangement comprising:

a support member including first and second, spaced side walls, said support member adapted to be movable into and out of the housing;

first and second bearings mounted in said first and second side walls, respectively, said first and second bearings having a common axis, said first bearing having a larger inner diameter than said second bearing;

first and second holder members fixed to said first and second side walls, respectively, said holder members each having an open upper end;

first and second bosses adapted to be connected to opposite axial ends of the drum and dimensioned to be received within said open upper ends of said first and second holder members, respectively, such that the drum and said bosses are supported by said holder members;

a rotary shaft extending through said first bearing, said first boss, said second boss and said second bearing, said rotary shaft having an inner end having a conical configuration and extending beyond said second bearing;

means for selectively securing said rotary shaft to one of said bosses, and means, adapted to be supported by the housing, for selectively imparting rotation to said inner end of said rotary shaft, and for thereby rotating the drum.

10. An arrangement as claimed in claim 9, wherein said rotation imparting means comprises an input end member surrounding said inner end of said rotary shaft and adapted to be rotated, said input end member having formed in an inner periphery thereof a plurality of radially outward extending and circumferentially extending recesses, each said recess having a surface inclined in a direction outwardly and in the direction of rotation, and a plurality of rollers positioned between the periphery of said rotary shaft and respective of said inclined surfaces, thereby forming a one-way clutch, such that rotation of said input end member forces said rollers between and against said inclined surfaces and said periphery of said rotary shaft, thus imparting rotation to said rotary shaft.

11. An arrangement as claimed in claim 9, wherein said securing means comprises an internal thread formed in an inner surface of said one boss and an external thread formed on said rotary shaft and engaging said internal thread, the direction of said threads being in a direction for mutual tightening during rotation of said rotary shaft during copying.

* * * * *